US010822924B2

(12) United States Patent
Konduc et al.

(10) Patent No.: US 10,822,924 B2
(45) Date of Patent: Nov. 3, 2020

(54) MULTI-WELL BOP CELLAR TRAILER

(71) Applicant: National Oilwell Varco, L.P., Houston, TX (US)

(72) Inventors: Kameron Wayne Konduc, Edmonton (CA); Randy Steven Stoik, Sherwood Park (CA); Roman Konowalec, Edmonton (CA); Jonathon Douglas Callaghan, Edmonton (CA); Li Liu, Edmonton (CA); David Frederick Chalus, Edmonton (CA)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 289 days.

(21) Appl. No.: 15/451,968

(22) Filed: Mar. 7, 2017

(65) Prior Publication Data

US 2017/0254181 A1 Sep. 7, 2017

Related U.S. Application Data

(60) Provisional application No. 62/304,674, filed on Mar. 7, 2016.

(51) Int. Cl.
*E21B 41/00* (2006.01)
*E21B 7/02* (2006.01)
(Continued)

(52) U.S. Cl.
CPC ..... *E21B 41/00* (2013.01); *E04B 1/34336* (2013.01); *E21B 7/02* (2013.01); *E21B 33/06* (2013.01); *E21B 15/00* (2013.01)

(58) Field of Classification Search
CPC . E21B 41/00; E21B 7/02; E21B 33/06; E21B 15/00; E04B 1/34336; E04B 1/343
See application file for complete search history.

(56) References Cited

U.S. PATENT DOCUMENTS 295,172 A 3/1884 Hill
1,557,070 A 10/1925 Logue
(Continued)

FOREIGN PATENT DOCUMENTS

CA 3016910 A1 9/2017
CN 101476312 7/2009
(Continued)

OTHER PUBLICATIONS

International Search Report and Written Opinion for related PCT Application No. PCT/US2017/021095, dated Jun. 12, 2017 (16 pages).

(Continued)

*Primary Examiner* — Yong-Suk (Philip) Ro
(74) *Attorney, Agent, or Firm* — Schwegman Lundberg & Lundberg, P.A.

(57) ABSTRACT

A drilling rig may include a detachable, modular cellar arranged beneath a drill floor of the drilling rig. The cellar may be or include a cellar trailer and it may also be configured to house drilling equipment, such as well head equipment and/or one or more blowout preventers. The cellar trailer may provide work areas, such that the well head equipment may be prepared, tested, or generally operated within the cellar trailer. The cellar trailer may additionally be configured to provide stiffening support to the drill floor in order to mitigate deflection of the drill floor during drilling operations. The stiffening support may be provided by a shear wall extending from the cellar trailer. The cellar trailer may be towable. The cellar trailer may additionally be skiddable and/or walkable.

8 Claims, 34 Drawing Sheets

(51) Int. Cl.

| | |
|---|---|
| ***E04B 1/343*** | (2006.01) |
| ***E21B 33/06*** | (2006.01) |
| *E21B 15/00* | (2006.01) |

(56) References Cited

U.S. PATENT DOCUMENTS

| | | | |
|---|---|---|---|
| 2,420,803 | A | 5/1947 | Tobin |
| 2,657,017 | A | 10/1953 | Curtis |
| 2,663,375 | A | 12/1953 | Caldwell |
| 2,781,108 | A | 2/1957 | Selberg et al. |
| 3,063,509 | A | 11/1962 | Guier |
| 3,099,323 | A | 7/1963 | Kelley |
| 3,228,151 | A | 1/1966 | Woolslayer et al. |
| 3,271,915 | A | 9/1966 | Woolslayer |
| 3,327,997 | A | 6/1967 | Zenke |
| 3,333,377 | A | 8/1967 | Woolslayer et al. |
| 3,421,596 | A | 1/1969 | Christensen |
| 3,477,235 | A | 11/1969 | Hester, Jr. |
| 3,483,933 | A | 12/1969 | Dyer |
| 3,502,166 | A | 3/1970 | Christenson et al. |
| 3,774,780 | A | 11/1973 | Buffington |
| 3,807,109 | A | 4/1974 | Jenkins et al. |
| 3,828,513 | A | 8/1974 | Vanderklaauw |
| 3,911,980 | A | 10/1975 | Mccoll |
| 3,922,825 | A | 12/1975 | Eddy et al. |
| 3,942,593 | A | 3/1976 | Reeve et al. |
| 3,949,818 | A | 4/1976 | Russell |
| 3,977,542 | A | 8/1976 | Stolzer |
| 4,068,487 | A | 1/1978 | Pease et al. |
| 4,081,932 | A | 4/1978 | Armstrong |
| 4,128,229 | A | 12/1978 | Elliston |
| 4,135,340 | A | 1/1979 | Cox et al. |
| 4,269,395 | A | 5/1981 | Newman et al. |
| 4,290,495 | A | 9/1981 | Elliston |
| 4,324,077 | A | 4/1982 | Woolslayer |
| 4,366,650 | A | 1/1983 | Patterson |
| 4,375,241 | A | 3/1983 | Gallon |
| 4,375,892 | A | 3/1983 | Jenkins et al. |
| 4,387,814 | A | 6/1983 | Beduhn et al. |
| 4,421,447 | A | 12/1983 | Gudgel |
| 4,587,778 | A | 5/1986 | Woolslayer et al. |
| 4,823,870 | A | 4/1989 | Sorokan |
| 4,831,795 | A | 5/1989 | Sorokan |
| 4,837,992 | A | 6/1989 | Hashimoto |
| 4,885,893 | A | 12/1989 | Wasterval, Jr. et al. |
| 5,216,867 | A | 6/1993 | Wasterval, Jr. et al. |
| 5,407,302 | A | 4/1995 | Springett et al. |
| 5,492,436 | A | 2/1996 | Suksumake |
| 5,954,453 | A | 9/1999 | Thomas |
| 5,997,217 | A | 12/1999 | Verret |
| 6,045,297 | A | 4/2000 | Voorhees et al. |
| 6,054,829 | A | 4/2000 | Young et al. |
| 6,141,870 | A | 11/2000 | McDermott et al. |
| 6,148,940 | A | 11/2000 | Hokanson et al. |
| 6,171,027 | B1 | 1/2001 | Blankestijin |
| 6,234,527 | B1 | 5/2001 | Poulin et al. |
| 6,286,615 | B1 | 9/2001 | Bitelli |
| 6,412,576 | B1 | 7/2002 | Meiners |
| 6,634,436 | B1 | 10/2003 | Desal |
| 6,729,804 | B1 | 5/2004 | Roodenburg et al. |
| 6,994,171 | B2 | 2/2006 | Orr et al. |
| 6,997,647 | B2 | 2/2006 | Bennett, Jr. et al. |
| 7,360,589 | B2 | 4/2008 | Moncus |
| 7,410,326 | B2 | 8/2008 | Morrison et al. |
| 7,584,809 | B1 | 9/2009 | Flud |
| 7,624,831 | B2 | 12/2009 | Orr et al. |
| 7,765,749 | B2 | 8/2010 | Paladis |
| 7,931,076 | B2 | 4/2011 | Ditta et al. |
| 7,950,478 | B2 | 5/2011 | Terry |
| 8,047,303 | B2 | 11/2011 | Donnally et al. |
| 8,287,212 | B2 | 10/2012 | Roper |
| 8,468,753 | B2 | 6/2013 | Donnally et al. |
| 8,516,751 | B2 | 8/2013 | Konduc et al. |
| 8,549,815 | B2 | 10/2013 | Donnally et al. |
| 8,555,564 | B2 | 10/2013 | Wasterval |
| 8,556,003 | B2 | 10/2013 | Souchek |
| 9,091,125 | B2 | 7/2015 | Konduc et al. |
| 9,091,126 | B2 | 7/2015 | Thiessen et al. |
| 9,109,399 | B2 | 8/2015 | Murr et al. |
| 9,212,778 | B2 | 12/2015 | Winter |
| 9,463,833 | B2 | 10/2016 | Smith et al. |
| RE46,723 | E | 2/2018 | Smith et al. |
| 9,926,719 | B2 | 3/2018 | Reddy et al. |
| 10,293,854 | B2 | 5/2019 | Nguyen et al. |
| 10,471,986 | B2 | 11/2019 | Nguyen et al. |
| 2002/0185319 | A1 | 12/2002 | Smith |
| 2003/0102166 | A1 | 6/2003 | Jortveit |
| 2003/0147726 | A1 | 8/2003 | Tolmon et al. |
| 2003/0172599 | A1 | 9/2003 | Frink |
| 2004/0151549 | A1 | 8/2004 | Roodenburg et al. |
| 2004/0211572 | A1 | 10/2004 | Orr et al. |
| 2004/0211598 | A1 | 10/2004 | Palidis |
| 2004/0240973 | A1 | 12/2004 | Andrews et al. |
| 2006/0180564 | A1 | 8/2006 | Keppel |
| 2007/0272762 | A1 | 11/2007 | Click et al. |
| 2008/0257607 | A1 | 10/2008 | Winter |
| 2009/0000218 | A1 | 1/2009 | Lee et al. |
| 2009/0188677 | A1 | 7/2009 | Ditta et al. |
| 2009/0283324 | A1 | 11/2009 | Konduc et al. |
| 2009/0321135 | A1 | 12/2009 | Vora |
| 2010/0150660 | A1 | 6/2010 | Nadarajah et al. |
| 2010/0260555 | A1 | 10/2010 | Foo et al. |
| 2010/0303586 | A1 | 12/2010 | Hankins et al. |
| 2011/0072737 | A1 | 3/2011 | Wasterval |
| 2011/0114386 | A1 | 5/2011 | Souchek |
| 2011/0280104 | A1 | 11/2011 | McClung, III |
| 2012/0047820 | A1 | 3/2012 | Donnally et al. |
| 2012/0138327 | A1 | 6/2012 | Sorokan et al. |
| 2012/0201632 | A1 | 8/2012 | Yater et al. |
| 2012/0304553 | A1 | 12/2012 | Konduc et al. |
| 2013/0168516 | A1 | 7/2013 | Winter |
| 2013/0180186 | A1 | 7/2013 | Konduc et al. |
| 2013/0269268 | A1 | 10/2013 | Thiessen et al. |
| 2013/0305632 | A1 | 11/2013 | Rivera et al. |
| 2013/0340572 | A1 | 12/2013 | Flusche |
| 2013/0340998 | A1 | 12/2013 | Flusche |
| 2013/0341036 | A1 | 12/2013 | Flusche |
| 2014/0041855 | A1 | 2/2014 | Rodgers |
| 2014/0090333 | A1 | 4/2014 | Vogt |
| 2014/0158342 | A1 | 6/2014 | Smith et al. |
| 2014/0259985 | A1 | 9/2014 | Petrello et al. |
| 2014/0262518 | A1 | 9/2014 | Reddy et al. |
| 2014/0262519 | A1 | 9/2014 | Pertello et al. |
| 2014/0262520 | A1 | 9/2014 | Petrello et al. |
| 2014/0263685 | A1 | 9/2014 | Yustus et al. |
| 2014/0270974 | A1 | 9/2014 | Seng et al. |
| 2014/0270975 | A1 | 9/2014 | Seng et al. |
| 2014/0331570 | A1 | 11/2014 | Fullerton et al. |
| 2015/0090450 | A1 | 4/2015 | Thiessen |
| 2015/0122558 | A1 | 5/2015 | Van Raden |
| 2015/0152690 | A1 | 6/2015 | Sorokan et al. |
| 2015/0184466 | A1 | 7/2015 | Rivera, Sr. et al. |
| 2015/0218891 | A1 | 8/2015 | Padira et al. |
| 2016/0052441 | A1 | 2/2016 | Korach |
| 2016/0369523 | A1 | 12/2016 | Konduc et al. |
| 2017/0241126 | A1 | 8/2017 | Konduc et al. |
| 2018/0093705 | A1 | 4/2018 | Nguyen et al. |
| 2018/0093706 | A1 | 4/2018 | Nguyen et al. |
| 2019/0233006 | A1 | 8/2019 | Nguyen et al. |

FOREIGN PATENT DOCUMENTS

| | | |
|---|---|---|
| CN | 102536267 | 7/2012 |
| RU | 81516 | 3/2009 |
| RU | 96904 | 8/2010 |
| RU | 137053 | 1/2014 |
| SU | 1461858 | 2/1989 |
| SU | 1686052 | 10/1991 |
| SU | 1770509 | 10/1992 |
| WO | 2004094762 | 11/2004 |
| WO | 2008114064 | 9/2008 |
| WO | 2009002189 | 12/2008 |
| WO | 2010132174 | 11/2010 |

(56) References Cited

FOREIGN PATENT DOCUMENTS

| | | | |
|---|---|---|---|
| WO | WO-2017155950 | A1 | 9/2017 |
| WO | WO-2018064746 | A1 | 4/2018 |
| WO | WO-2020028969 | A1 | 2/2020 |

OTHER PUBLICATIONS

*Blue Calypso, LLC* v. *Groupon, Inc.* (CAFC, Mar. 1, 2016) (46 pages).
Extended European Search Report for European Patent Application No. 12791970.2, dated Sep. 2, 2015 (8 pages).
Formal Response to Written Opinion of the International Searching Authority for PCT/CA2012/000510, filed Mar. 14, 2013 (4 pages).
In re Wolfensperger, 302 F.2d 950 (CCPA 1962), dated May 18, 1962 (8 pages).
International Search Report and Written Opinion for related PCT Application No. PCT/CA2015/000432 dated Sep. 24, 2015 (9 pages).
International Search Report and Written Opinion for related PCT Application No. PCT/CA2016/000229 dated Oct. 26, 2016 (9 pages).
International Search Report and Written Opinion for related PCT Application No. PCT/US2014/037431, dated Oct. 7, 2014 (17 pages).
International Search Report and Written Opinion for related PCT Application No. PCT/US2016/019507 dated Dec. 21, 2016 (17 pages).
National Oilwell Varco Elevator/Substructure/Setback Cross-Section drawing dated Jul. 24, 1979 (1 page).
National Oilwell Varco Mast & Substructure Erection Sequence drawing dated Sep. 15, 1979 (1 page).
Response to Extended European Search Report for EP 12791970.2, filed Mar. 9, 2016 (35 pages).
Written Opinion of the International Searching Authority for PCT Application No. PCT/CA2012/000510, dated Aug. 24, 2012 (3 pages).
Photographs of typical Uralmesh train rig, Sep. 2012 (2 pages).
Photograph of Uralmesh rig, Jul. 2014 (1 page).
"International Application Serial No. PCT/US2017/021095, International Preliminary Report on Patentability dated Sep. 20, 2018", 11 pgs.
"Ackerman steering geometry", Wikipedia, [Online] Retrieved from the Internet : <https://en.wikipedia.org/wiki/Ackermann_steering_geometry>, (Accessed Jan. 11, 2017), 3 pgs.
"U.S. Appl. No. 15/285,946, Non Final Office Action dated Dec. 11, 2018", 8 pgs.
"U.S. Appl. No. 15/285,946, Notice of Allowance dated Jul. 9, 2019", 5 pgs.
"U.S. Appl. No. 15/285,946, Response filed Sep. 5, 2018 to Restriction Requirement dated Jul. 5, 2018", 6 pgs.
"U.S. Appl. No. 15/285,946, Response filed Mar. 11, 2019 to Non-Final Office Action dated Dec. 11, 2018", 8 pgs.
"U.S. Appl. No. 15/285,946, Restriction Requirement dated Jul. 5, 2018", 6 pgs.
"U.S. Appl. No. 15/349,661, Notice of Allowance dated Jan. 3, 2019", 8 pgs.
"U.S. Appl. No. 15/349,661, Response filed Oct. 26, 2018 to Restriction Requirement dated Aug. 28, 2018", 6 pgs.
"U.S. Appl. No. 15/349,661, Restriction Requirement dated Aug. 28, 2018", 5 pgs.
"U.S. Appl. No. 16/382,961, Non Final Office Action dated May 14, 2020", 7 pgs.
"Axles & Suspension Wheeled Moving System", Columbia Industries, [Online] Retrieved from the Internet: <http://www.joomag.com/magazine/columbiaindustries/0320299001391629028>, (Accessed Jan. 11, 2017), 4 pgs.
"Axles and Suspension", Columbia Industries, [Online] Retrieved from the Internet : <http://www.columbiacorp.com/axlesandsuspension.php>, (Mar. 17, 2016), 2 pgs.
"Canadian Application Serial No. 3,016,910, Voluntary Amendment filed Jul. 8, 2019", 13 pgs.
"Entro Heavy Haul", Entro Industries, [Online] Retrieved from the Internet ; <https://entro-eng.com/products/heavy-haul/heavy-haul-overview/>, (Accessed Jan. 11, 2017), 2 pgs.
"Entro Industries Homepage", [Online] Retrieved from the Internet : <https://entroeng.com/>, (Accessed Jan. 18, 2017), 2 pgs.
"International Application Serial No. PCT/CA2017/000215, International Preliminary Report on Patentability dated Jan. 21, 2019", 5 pgs.
"International Application Serial No. PCT/CA2017/000215, International Search Report dated Jan. 9, 2018", 4 pgs.
"International Application Serial No. PCT/CA2017/000215, Written Opinion dated Jan. 9, 2018", 6 pgs.
"International Application Serial No. PCT/CA2019/000114, Article 34 Amendments filed Jun. 1, 2020", 8 pgs.
"International Application Serial No. PCT/CA2019/000114, International Search Report dated Nov. 20, 2019", 3 pgs.
"International Application Serial No. PCT/CA2019/000114, Written Opinion dated Nov. 20, 2019", 5 pgs.
"Nabors Oil Rig Move", YouTube, [Online] Retrieved from the Internet ; <https://www.youtube.com/watch?v=T4ELOeh6R6M>, (Oct. 22, 2008), 2 pgs.
"Pin-on Walkers for Ideal® Rigs", Entro Industries, [Oniine] Retrieved from the Internet : <https://entro-eng.com/products/walking-systems/ideal-pin-on-waikers/>, (Accessed Jan. 11, 2017), 2 pgs.
"Steering", Wikipedia, [Online] Retrieved from the Internet : <https://en.wikipedia.org/wiki/Steering>, (Accessed Jan. 11, 2017), 12 pgs.
U.S. Appl. No. 15/285,946 U.S. Pat. No. 10,471,986, filed Oct. 5, 2016, Movable Rig and Steering System.
U.S. Appl. No. 15/349,661 U.S. Pat. No. 10,293,854, filed Nov. 11, 2016, Movable Rig and Steering System.
U.S. Appl. No. 16/382,961, filed Apr. 12, 2019, Movable Rig and Steering System.
U.S. Appl. No. 16/557,644, filed Aug. 30, 2019, Cuttings Processing Unit.

MULTI-WELL BOP CELLAR TRAILER

CROSS-REFERENCE TO RELATED APPLICATIONS

The present application claims priority to U.S. Provisional Patent Application No. 62/304,674, filed on Mar. 7, 2016, entitled MULTI WELL BOP CELLAR TRAILER, the content of which is hereby incorporated by reference herein in its entirety.

FIELD OF THE INVENTION

The present application is generally directed to drilling rig assemblies. Particularly, the present disclosure relates to drilling rig assemblies having a modular, detachable cellar trailer. More particularly, the present disclosure relates to a modular, detachable drilling rig cellar trailer configured to house drilling equipment during roading and drilling operations.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Rigs drilling in the high Arctic may include sealed units to retain heat during drilling operations and rig moves. These rigs may move as a convoy of trailers towed by trucks and self-propelled units as they move between drilling pads in the high Arctic. The typical rig move between pads may be several hundred yards or several miles. The complete rig may also move from well to well on the pad during drilling operations. During rig moves, the loads may be maintained below the tire capacity, bridge capacity, ice road capacity, or other limiting factors. Arctic wells may be drilled to depths of up to or exceeding 35,000 feet in some cases.

Drilling to great depths may require relatively large drilling rigs and relatively heavy equipment. For example, a relatively large wellhead Christmas tree and blowout preventer may be needed. These devices can add hundreds of thousands of pounds to the drill rig, and their height may require a relatively tall drill floor to allow for clearance of the Christmas tree and blowout preventer.

One style of rig for Arctic drilling is a cantilevered style. In a cantilevered style rig, the drill floor, mast, and well center may be cantilevered out over the well and wellhead to provide suitable vertical clearance for drilling operations. The cantilevered nature of the rig may enable the rig to traverse along a row of wells, completing each well as it moves parallel to the row of wells. However, as the drilling hookload on these cantilevered rigs increases during drilling operations, the drill floor may deflect downward as a result of the cantilevered design. Vertical stiff legs may be added at the back of the rig to support the cantilever. These legs add weight and may make the rig more cumbersome to move along a row of wells, for example.

As a drilling rig moves among multiple wells, such as on a multi-well pad drilling site, each well head may require set up, preparation, and testing prior to drilling operations at that well. Such set up, preparation, and testing may add time to the drilling operations. Additionally, after drilling is completed at a well, time may be spent closing down the well head. These set up and closing times, particularly on a drilling site having multiple wells can add a significant amount of time to the overall drilling operation, increasing the amount of time that the drilling rig has to spend at each well head.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a modular drilling cellar trailer configured to be arranged beneath a drill floor of a drilling rig. The trailer may include a housing for storing well head equipment, a frame coupled to and supporting the housing, and a shear wall configured to extend between the trailer and a ground or pad surface and configured to provide stiffening support to the drill floor of the drilling rig. In some embodiments, the housing may have a plurality of substructure enclosures. The well head equipment may include at least one blowout preventer. The frame may have a pair of bearing feet. In some embodiments, the bearing feet may be inner bearing feet, and the frame may additionally have a pair of outer bearing feet. The inner bearing feet may be configured to engage a rail. In some embodiments, the frame may have at least two tires. Moreover, the shear wall may include a pair of bearing pads.

The present disclosure, in one or more embodiments, additionally relates to a drilling rig having a drill floor and a modular, detachable cellar arranged beneath the drill floor. The modular cellar may have a housing for storing well head equipment, a frame coupled to and supporting the housing, and a shear wall configured to extend between the trailer and a ground or pad surface and configured to provide stiffening support to the drill floor. The housing may have a plurality of substructure enclosures. The well head equipment may include at least one blowout preventer. The frame may have a pair of bearing feet. In some embodiments, the bearing feet may be inner bearing feet, and the frame may additionally have a pair of outer bearing feet. The inner bearing feet may be configured to engage a rail. In some embodiments, the frame may have at least two tires. The shear wall may have a pair of bearing pads in some embodiments.

The present disclosure, in one or more embodiments, additionally relates to a method of drilling. The method may include the steps of towing a cellar trailer to a drilling site. The cellar trailer may have a housing for storing well head equipment, a frame coupled to and supporting the housing, and a shear wall configured to extend between the trailer and a ground surface and configured to provide stiffening support to the drill floor. The method may additionally include positioning the cellar trailer over a well head, positioning the drill rig such that a drill floor is arranged over the cellar trailer, coupling the drill floor to the cellar trailer, and stiffening the drill floor by arranging a shear wall between the trailer and a ground or pad surface. In some embodiments, the drill rig is a cantilever-style drill rig. The cellar trailer may include an inner pair of bearing feet and an outer pair of bearing feet. In some embodiments, the well head may be one of a row of well heads, and the cellar trailer may be configured to skid parallel to the row of well heads to a next well head.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to a drilling rig having a detachable, modular cellar arranged beneath a drill floor of the drilling rig. The cellar may be or include a cellar trailer and may be configured to house drilling equipment, such as well head equipment. For example, the cellar trailer may house one or more blowout preventers and/or other well head equipment. In some embodiments, the cellar trailer may provide work areas, such that the well head equipment may be prepared, tested, or generally operated within the cellar trailer. The cellar trailer may additionally be configured to provide structural support to the drilling rig. For example, the cellar trailer may provide stiffening support to the drill floor in order to mitigate deflection of the drill floor during drilling operations. The stiffening support may be provided by a shear wall extending from the cellar trailer. The cellar trailer may be towable, such as by a towing vehicle. The cellar trailer may additionally be skiddable and/or walkable in some embodiments. A cellar trailer of the present disclosure may generally allow work to begin on a well without the drilling rig present, and may additionally allow work to be completed on a well without the drilling rig present, which may decrease overall drilling operation time. Additionally, a cellar trailer of the present disclosure may significantly reduce equipment load on the drilling rig.

Figure 1:
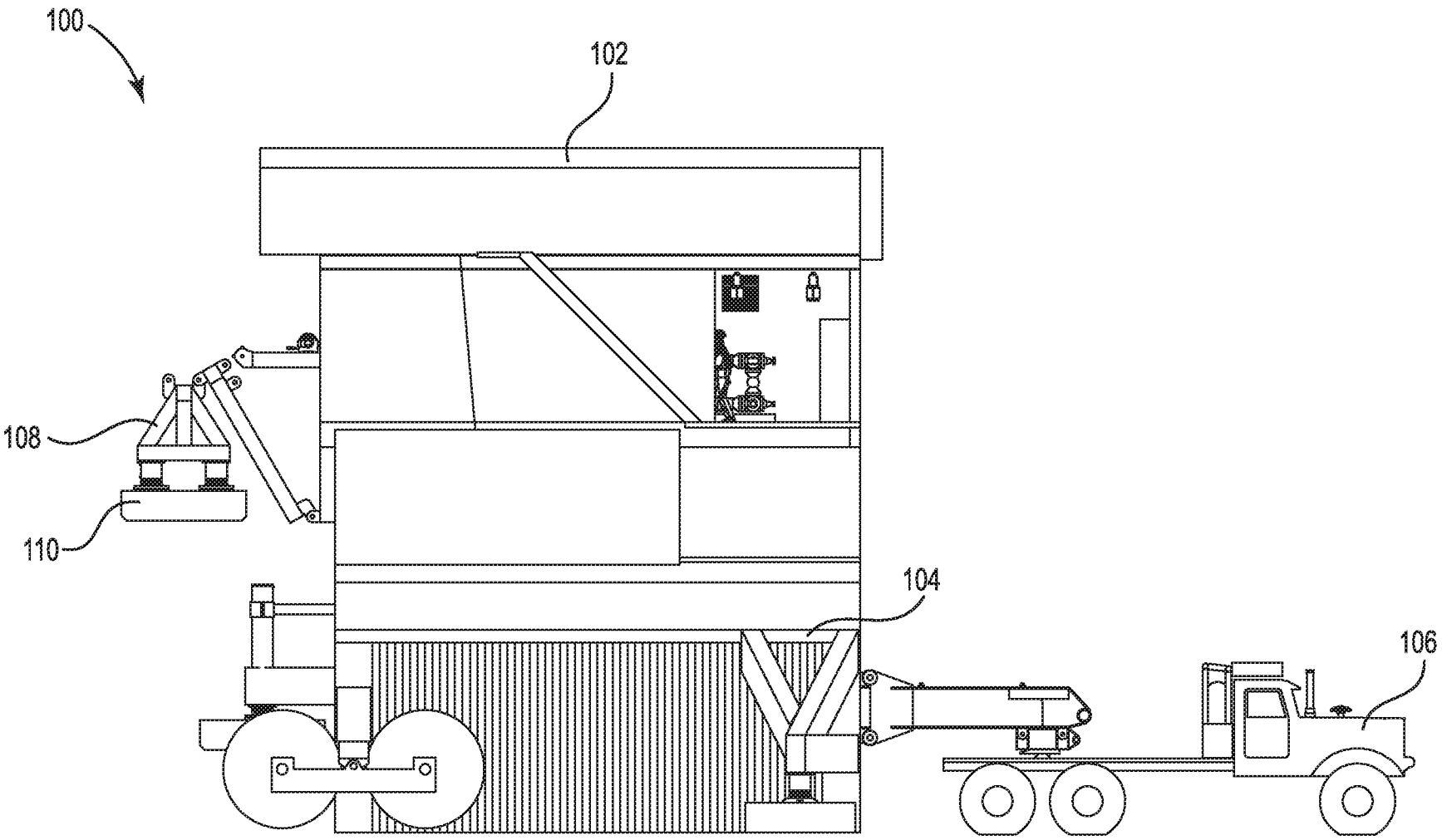
FIG. 1 is a side view of a cellar trailer of the present disclosure, according to one or more embodiments.
Figure 2:
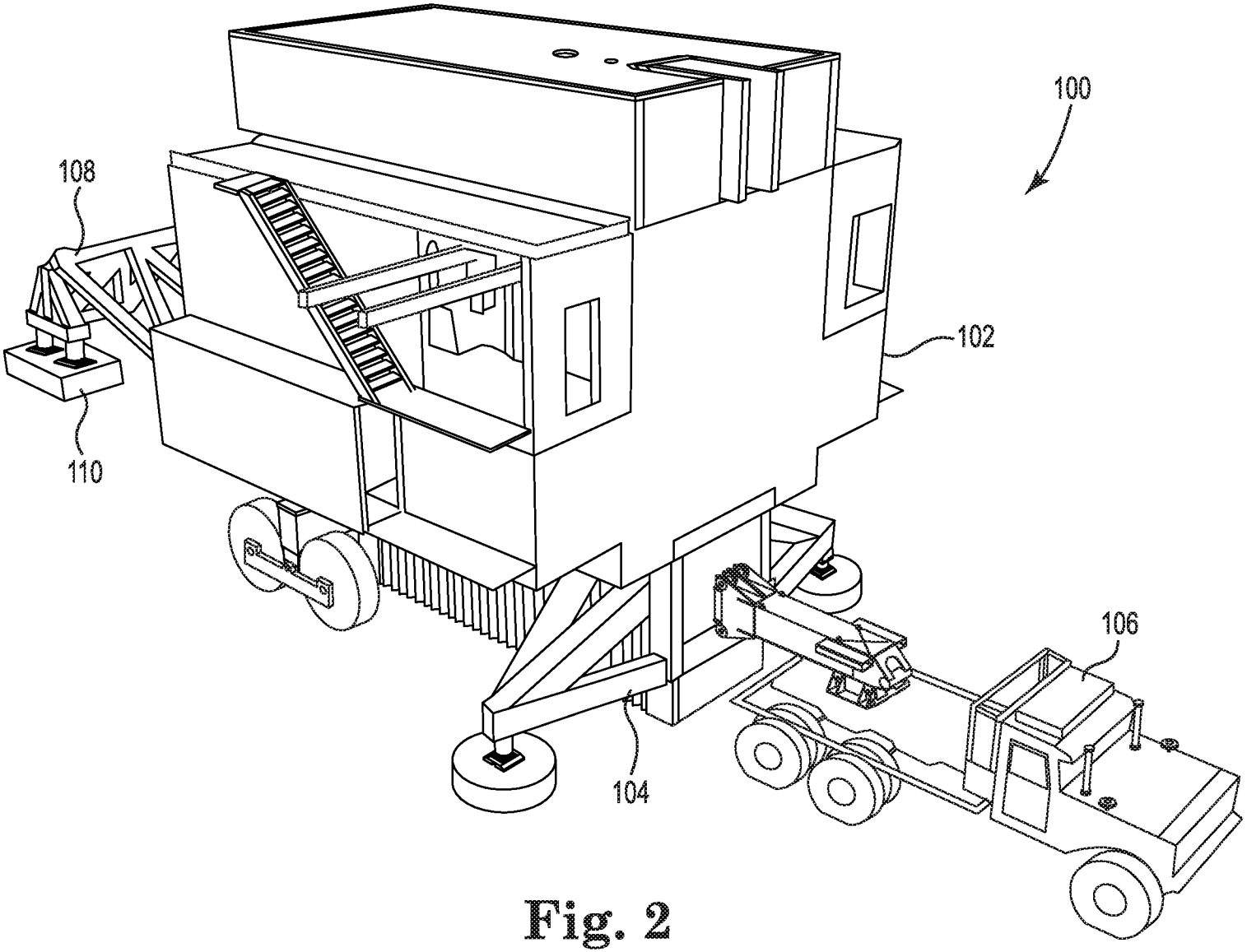
FIG. 2 is a perspective view of a cellar trailer of the present disclosure, according to one or more embodiments.
Figure 3:
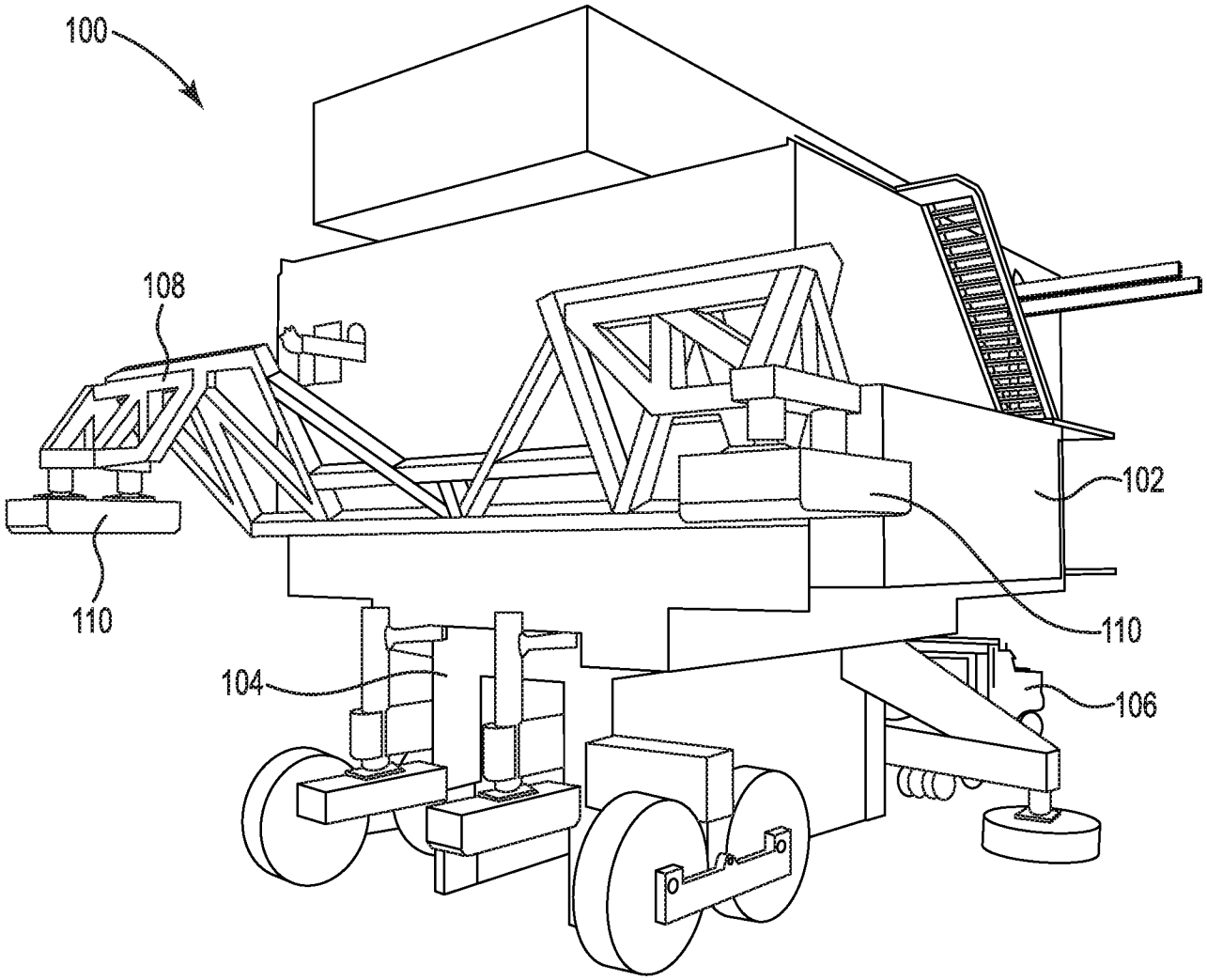
FIG. 3 is another perspective view of a cellar trailer of the present disclosure, according to one or more embodiments.
Figure 4:
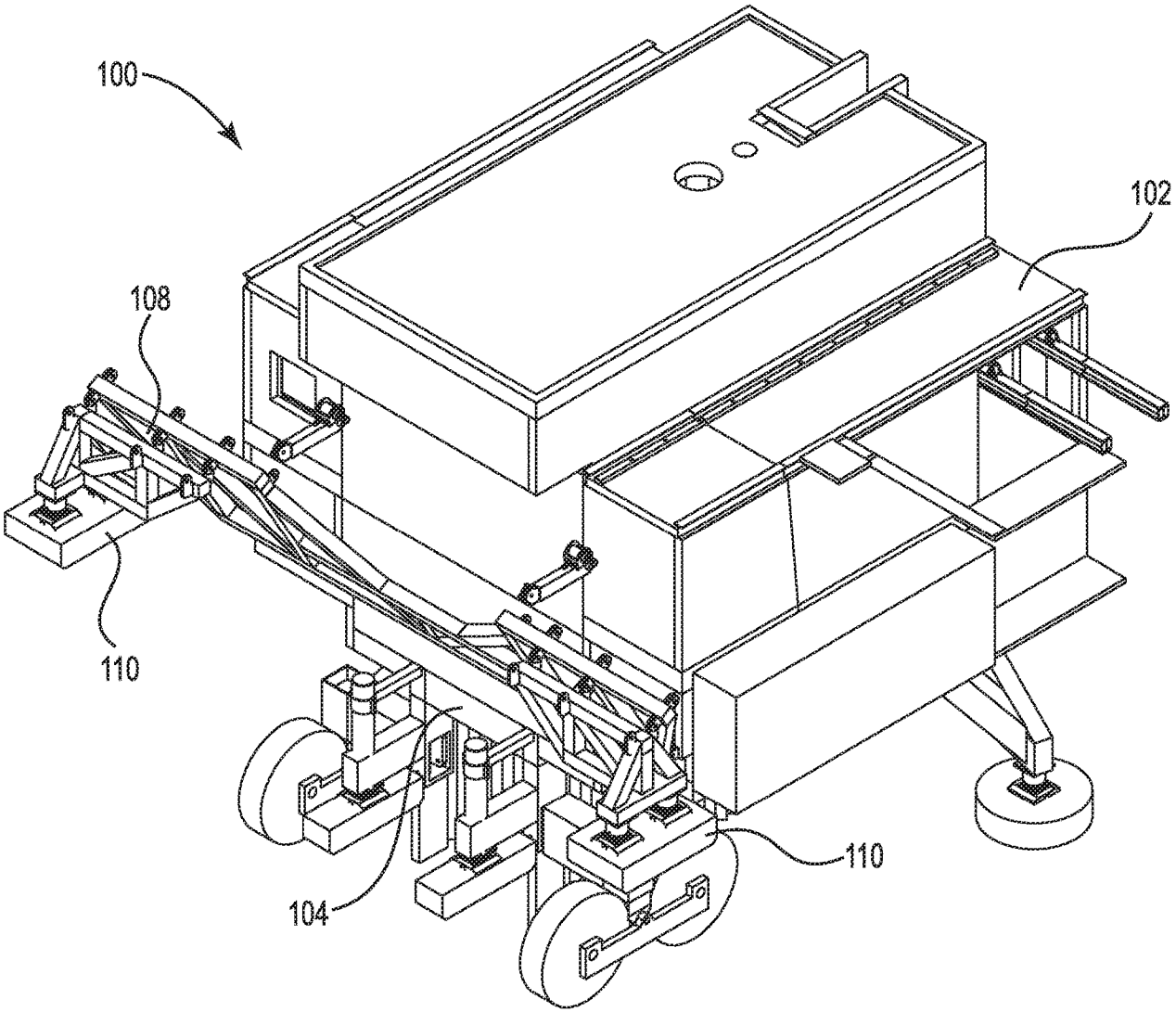
FIG. 4 is another perspective view of a cellar trailer of the present disclosure, according to one or more embodiments.

Turning now to FIG. 1, a cellar trailer 100 of the present disclosure is shown. FIGS. 2-4 show perspective views of the cellar trailer 100. The cellar trailer 100 may be configured to house one or more blowout preventers, such as a primary or main blowout preventer and a diverter blowout preventer for a drilling operation. The cellar trailer 100 may additionally or alternatively hold other drilling equipment in some embodiments. The cellar trailer 100 may be configured to be arranged beneath a drill floor of a drilling rig or drilling module, and over a well head, such that the blowout preventer(s) and/or other drilling equipment may be operated during a drilling operation. In this way, the cellar trailer 100 may be configured to maintain the blowout preventer(s) and/or other drilling equipment modularly and separate from the drill rig or drilling module itself. The cellar trailer 100 may generally be configured to couple to a drilling rig or drilling module. In some embodiments, the cellar trailer 100 may be configured to support or stiffen the drill floor of the drilling rig or module, by passing loading from the drill floor through the cellar trailer to the ground or pad surface. In some embodiments, the cellar trailer 100 may be towable by a truck, tractor, or other towing vehicle, such that the trailer may be moved between drilling locations, such as between drilling pads and/or among wells on a multi-well drilling pad. The cellar trailer 100 may generally have a housing 102 arranged on a frame 104. The frame 104 may be coupled to a towing vehicle 106. The trailer 100 may additionally have a shear wall 108 with one or more bearing pads 110.

Figure 5:
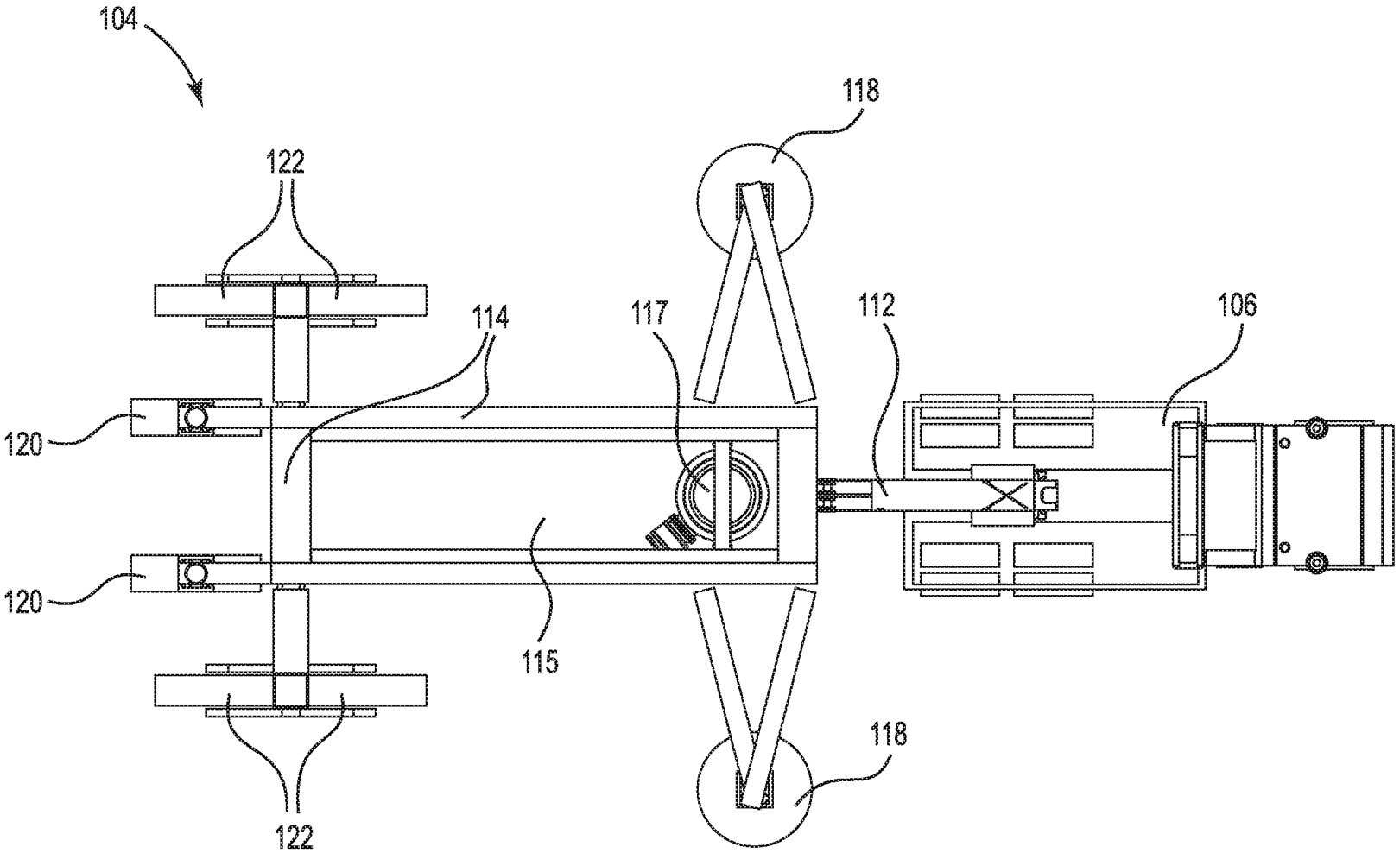
FIG. 5 is an overhead view of a frame of a cellar trailer of the present disclosure, according to one or more embodiments.
Figure 6:
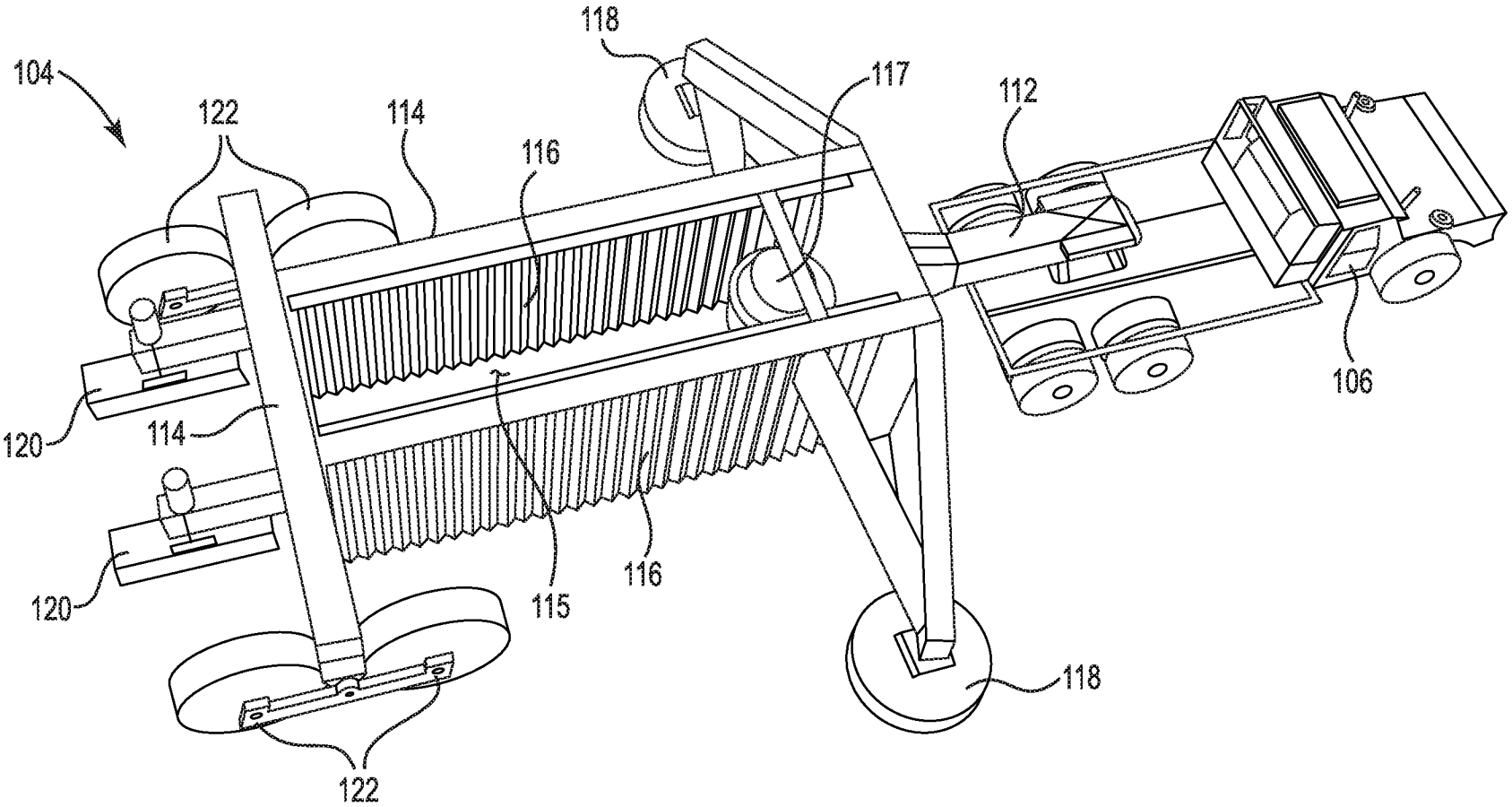
FIG. 6 is a perspective view of a frame of a cellar trailer of the present disclosure, according to one or more embodiments.

FIGS. 5 and 6 show overhead and perspective views of the frame 104, respectively. The frame 104 may be configured to support the housing 102, as well as the blowout preventer(s) and/or any other drilling equipment within the housing. The frame 104 may additionally be configured to transfer loading from the trailer 100 and on the trailer from the drill floor to the ground via one or more tires, bearing feet, skidding feet, and/or walking feet. In some embodiments, the frame 104 may have a trailer hitch 112 arranged on a tow end. The hitch 112 may include a ball hitch, pintle hook, fifth wheel hitch, or other towing device such that the trailer may be towed by a towing vehicle. The frame 104 may generally be constructed of steel or other suitable materials. In some embodiments, the frame may have a plurality of support beams 114, a pair of sidewalls 116, a pair of outer bearing feet 118, a pair of inner bearing feet 120, and one or more pairs of tires 122.

The plurality of support beams 114 may generally be configured to support the housing 102 and drilling equipment, such as one or more blowout preventers. The support beams 114 may additionally be configured to provide ground clearance beneath the housing 102, such that the trailer 100 may be towed or skidded over a well head. In some embodiments, the support beams 114 may provide a ground clearance of between approximately 5 and approximately 25 feet. Particularly, the ground clearance may be between 10 and 15 feet in some embodiments. In other embodiments, the plurality of support beams 114 may provide more or less ground clearance. In some embodiments, an area between the support beams 114 and ground surface, and thus arranged beneath the housing, may be a lower cellar area 115.

In some embodiments, one or more sidewalls 116 may extend from the support beams 114 in order to provide a housing or partial housing for the lower cellar area 115. For example, in some embodiments, a sidewall 116 may extend around each of at least two sides of the lower cellar area 115. In some embodiments, one or more sidewalls 116 may be retractable and/or readily removable so as to allow the trailer 100 to move over or across equipment and/or well heads. The lower cellar area 115 may provide a housing for the well head. In some embodiments, the lower cellar area 115 may additionally store equipment, such as a diverter blowout preventer 117 and/or other drilling equipment. In some embodiments, the lower cellar area 115 may have hoisting and/or handling equipment for moving the diverter blowout preventer 117 and/or other equipment. Such hoisting and/or handling equipment may be coupled to the frame 104 in some embodiments.

An outer bearing foot 118 may be coupled to each of two sides of the frame 104 at the tow end in some embodiments. For example, beams 114 may extend laterally from the frame 104 on each of a driller side and an off-driller side to provide an outer bearing foot 118. The outer bearing feet 118 may help to stabilize the trailer 100. In some embodiments, the outer bearing feet 118 may be configured to be arranged in one or more positions, such as a roading position and a drilling position. For example, each bearing foot 118 may couple to the frame 104 with a hydraulic cylinder. In a roading position, the hydraulic cylinders may be retracted such that the bearing feet 118 may be above ground level, and such that the trailer 100 may be supported by the tires 122. In a drilling position, the hydraulic cylinders may extend, such that the bearing feet 118 may be arranged on a ground or pad surface to help support, stabilize, and/or level the trailer 100. In some embodiments, the outer bearing feet 118 may have a walking or skidding mechanism, such that the outer bearing feet may be used to move the trailer 100 in one or more directions. In some embodiments, the outer bearing feet 118 may allow for bi-directional movement of the trailer 100.

Similarly, the trailer 100 may additionally or alternatively have a pair of inner bearing feet 120 coupled to the frame 104, such as coupled to a rear portion of the frame opposite the tow end and extending rearwardly from the trailer. The inner bearing feet 120 may help to stabilize the trailer 100. In some embodiments, the inner bearing feet 120 may be configured to be arranged in one or more positions, such as a roading position and a drilling position. For example, each bearing foot 120 may couple to the frame 104 with a hydraulic cylinder. In a roading position, the hydraulic cylinders may be retracted such that the bearing feet 120 may be above ground level, and such that the trailer 100 may be supported by the tires 122. In a drilling position, the hydraulic cylinders may extend, such that the bearing feet 120 may be arranged on a ground or pad surface to help support, stabilize, and/or level the trailer 100. In some embodiments, the inner bearing feet 120 may additionally be configured for arranging in a skidding position. For example, the inner bearing feet 120 may be configured to be arranged on a rail or set of rails along a ground or pad surface. The rails may allow the inner bearing feet 120 to help support the trailer 100 as the trailer is skidded or otherwise moved between well heads along a row of wells, for example. In some embodiments, the skidding position may include retracting or extending the hydraulic cylinders to bring the inner bearing feet 120 to a height corresponding with the rail(s). The skidding position may additionally include rotating the inner bearing feet 120 in some embodiments. For example, the inner bearing feet 120 may be rotated approximately 90 degrees in order to engage the rail(s). Additionally or alternatively, in some embodiments, the inner bearing feet 120 may have a walking or skidding mechanism. In some embodiments, the inner bearing feet 120 may allow for bi-directional movement of the trailer. The inner 120 and outer 118 bearing feet may operate in conjunction with one another to facilitate skidding or walking movement of the trailer 100 in some embodiments.

The trailer 100 may additionally have one or more tires 122 or pairs of tires, which may be coupled to the frame 104. For example, one pair of tires 122 may extend from the frame 104 on each of a driller side and an off-driller side of the trailer 100. The tires 122 may generally be sized to support the equipment loading on the trailer 100 and, in some embodiments, applied loading from drilling operations. The tires 122 may generally be configured to be arranged in multiple positions. For example, in a roading position, the tires may be arranged on the frame 104 and in contact with a ground or pad surface. Additionally, in the roading position, the tires 122 may be arranged in an orientation paralleling that of the tires of a towing vehicle 106, such that the tires 122 may operate to move the trailer 100 in the direction of towing. In some embodiments, the tires 122 may be removed during drilling and/or other operations. In some embodiments, the tires 122 may additionally be configured for arranging in a skidding position. In a skidding position, the tires may be rotated approximately 90 degrees to an orientation such that the tires may operate to move the trailer 100 in a direction perpendicular to that of the towing direction.

Figure 7:
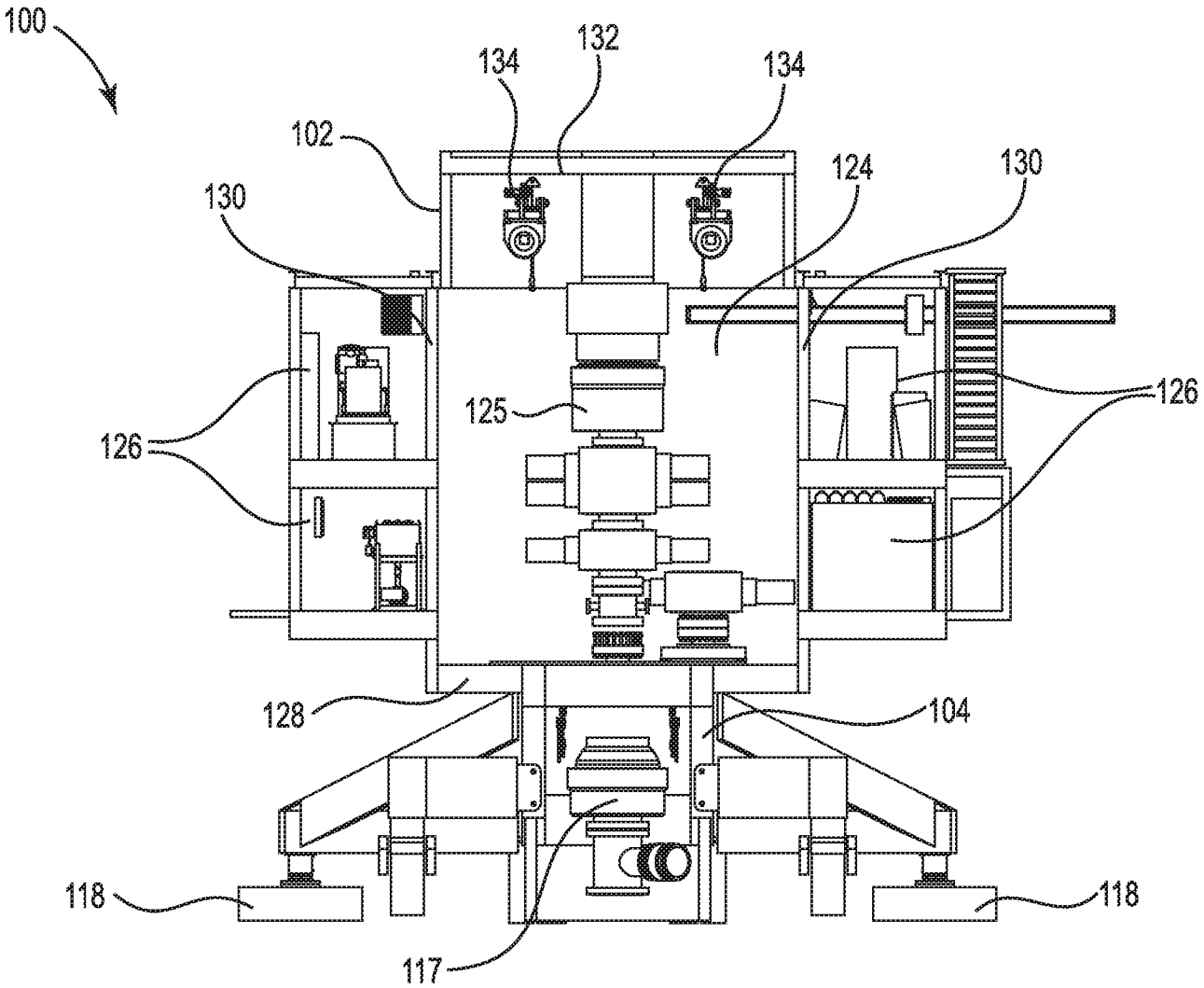
FIG. 7 is an internal end view of a cellar trailer of the present disclosure, according to one or more embodiments.
Figure 8:
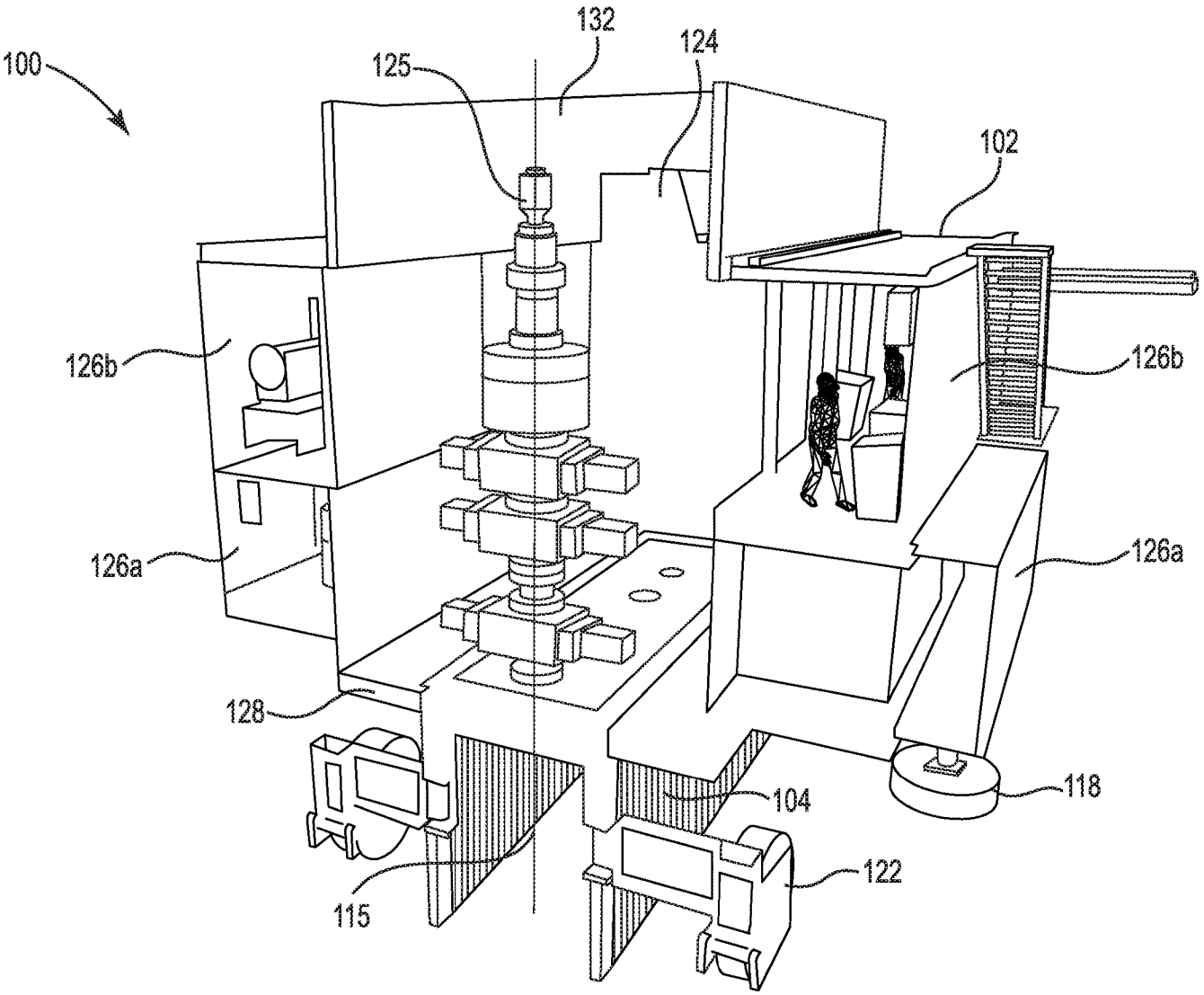
FIG. 8 is a perspective internal view of a cellar trailer of the present disclosure, according to one or more embodiments.

The housing 102 may be arranged on, and may be generally supported by, the frame 104. The housing 102 may be configured to house one or more blowout preventers, such as a main blowout preventer 125 and/or other drilling equipment. The housing 102 may additionally provide a work area for workers during drilling operations. The housing 102 may be configured to provide an enclosed or partially enclosed environment around the well head to contain gasses. The housing 102 may additionally be configured to provide one or more enclosed work environments for workers, thus providing protection from the environment. In some embodiments, the housing 102 or a portion thereof may be climate controlled. For example, with respect to Arctic drilling operations, the housing 102 or a portion thereof may be heated. As shown in FIGS. 7 and 8, the housing 102 may generally be divided into a mezzanine 124 and one or more subassemblies 126 arranged around the mezzanine.

Figure 9:
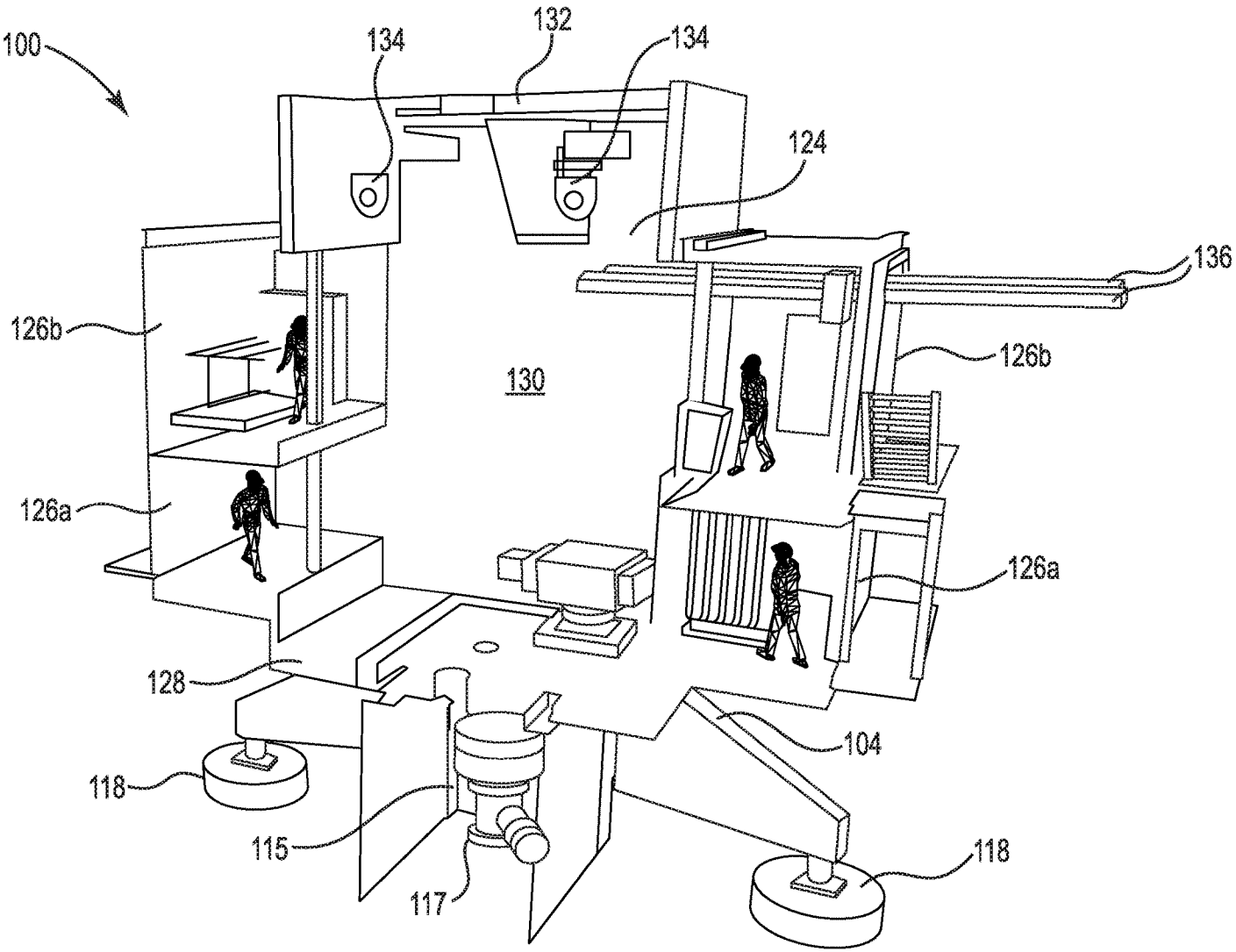
FIG. 9 is a perspective internal view of a cellar trailer of the present disclosure, according to one or more embodiments.
Figure 10:
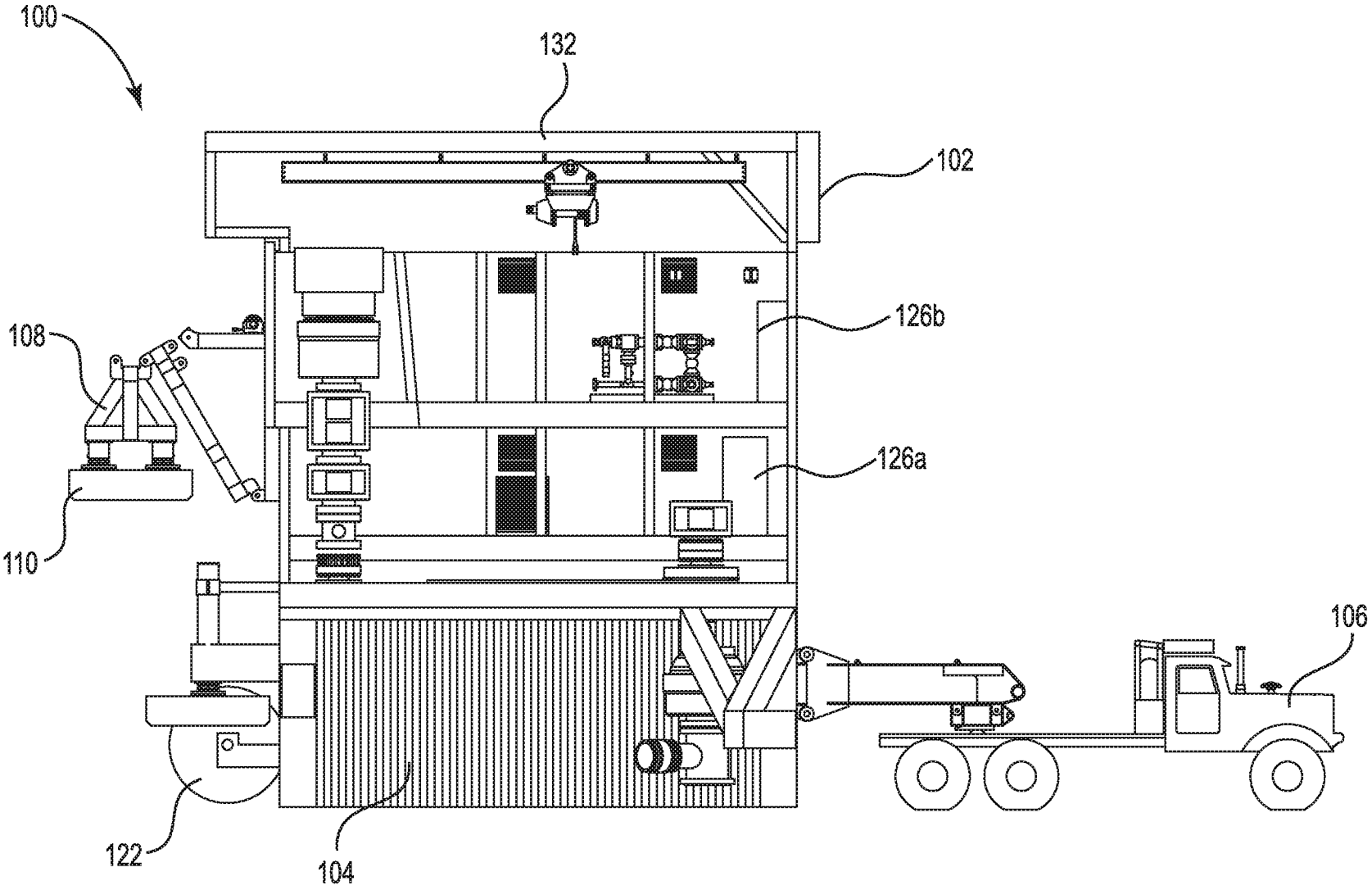
FIG. 10 is a side internal view of a cellar trailer of the present disclosure, according to one or more embodiments.
Figure 11:
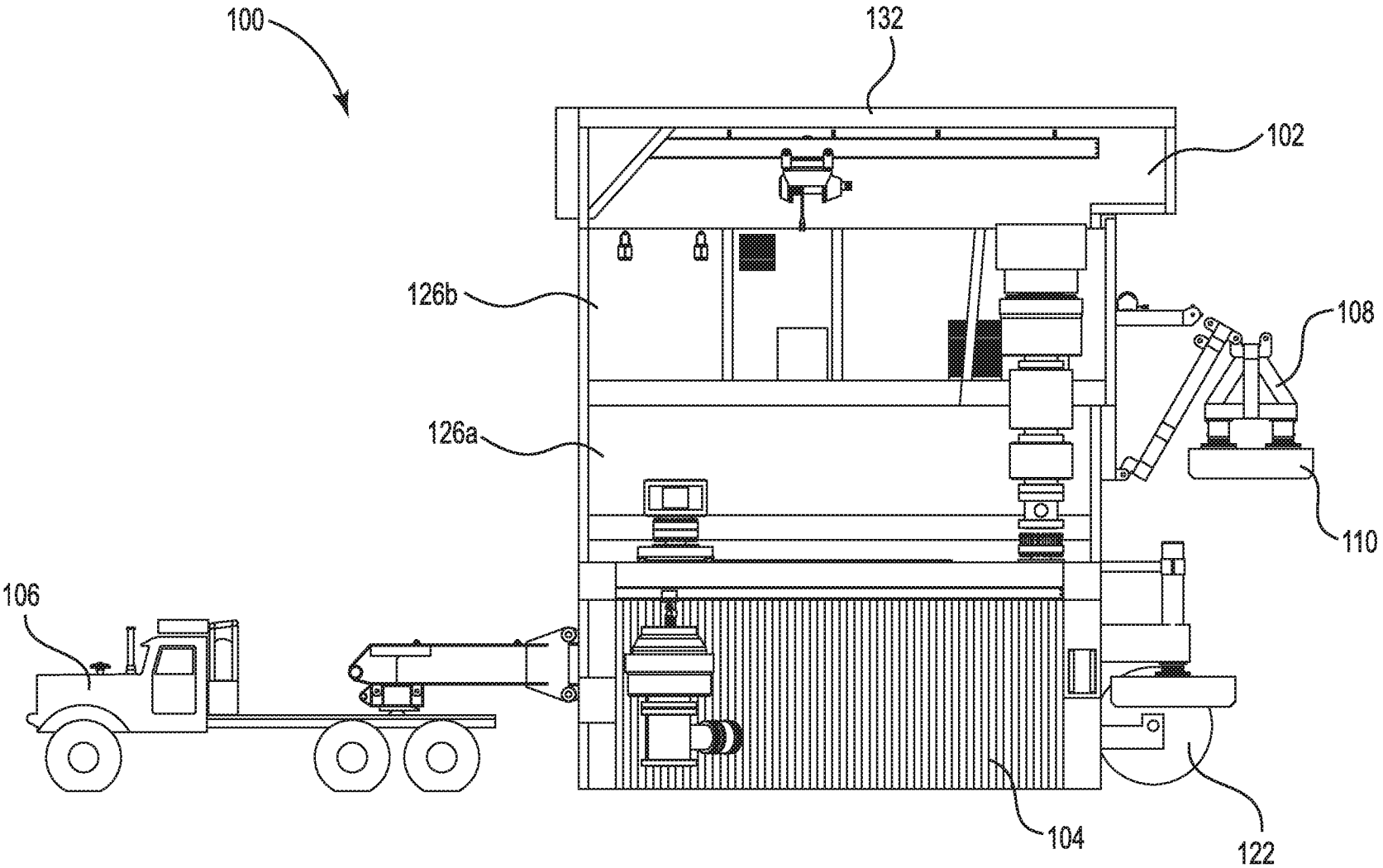
FIG. 11 is another side internal view of a cellar trailer of the present disclosure, according to one or more embodiments.
Figure 12:
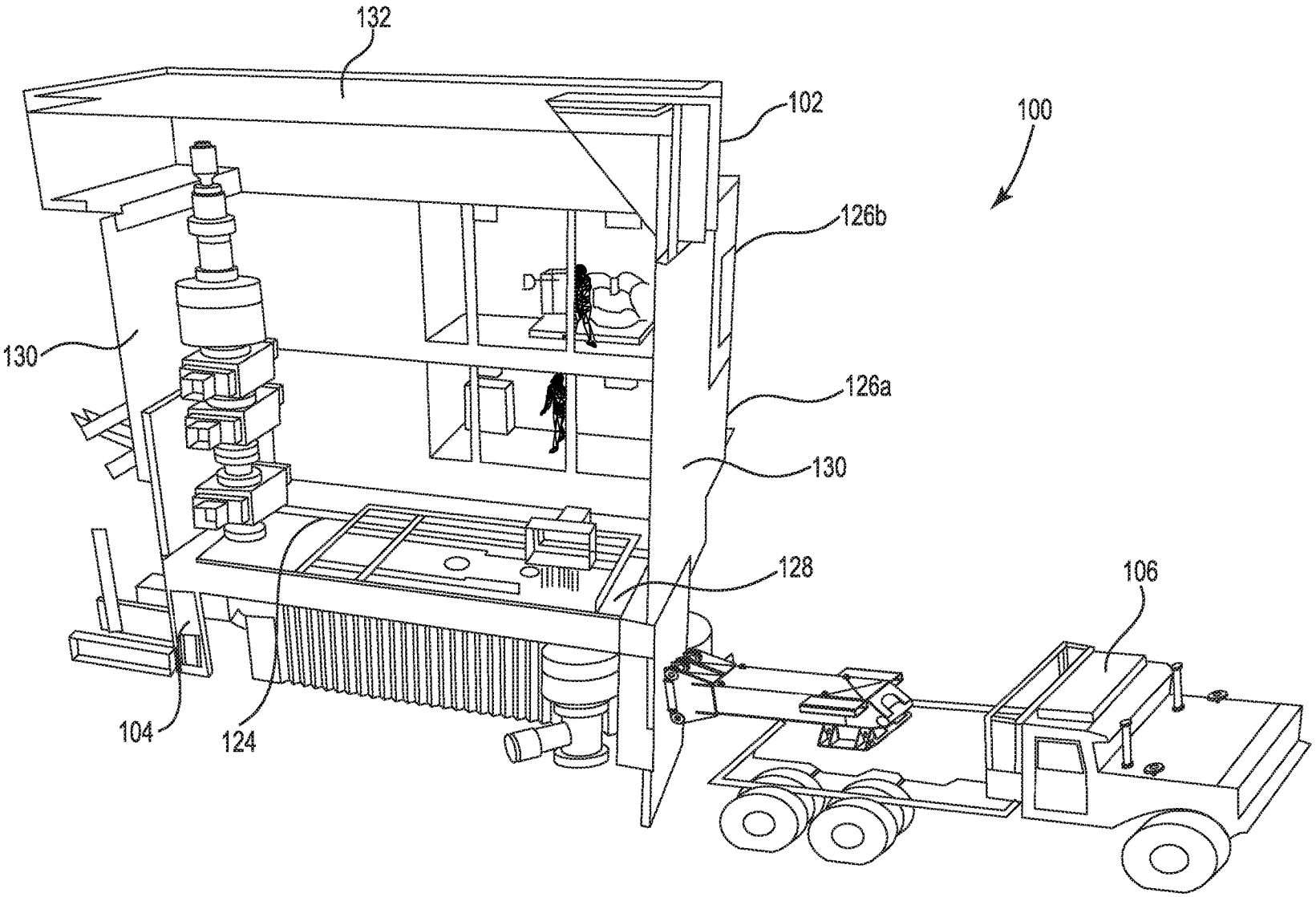
FIG. 12 is a perspective internal view of a cellar trailer of the present disclosure, according to one or more embodiments.
Figure 13:
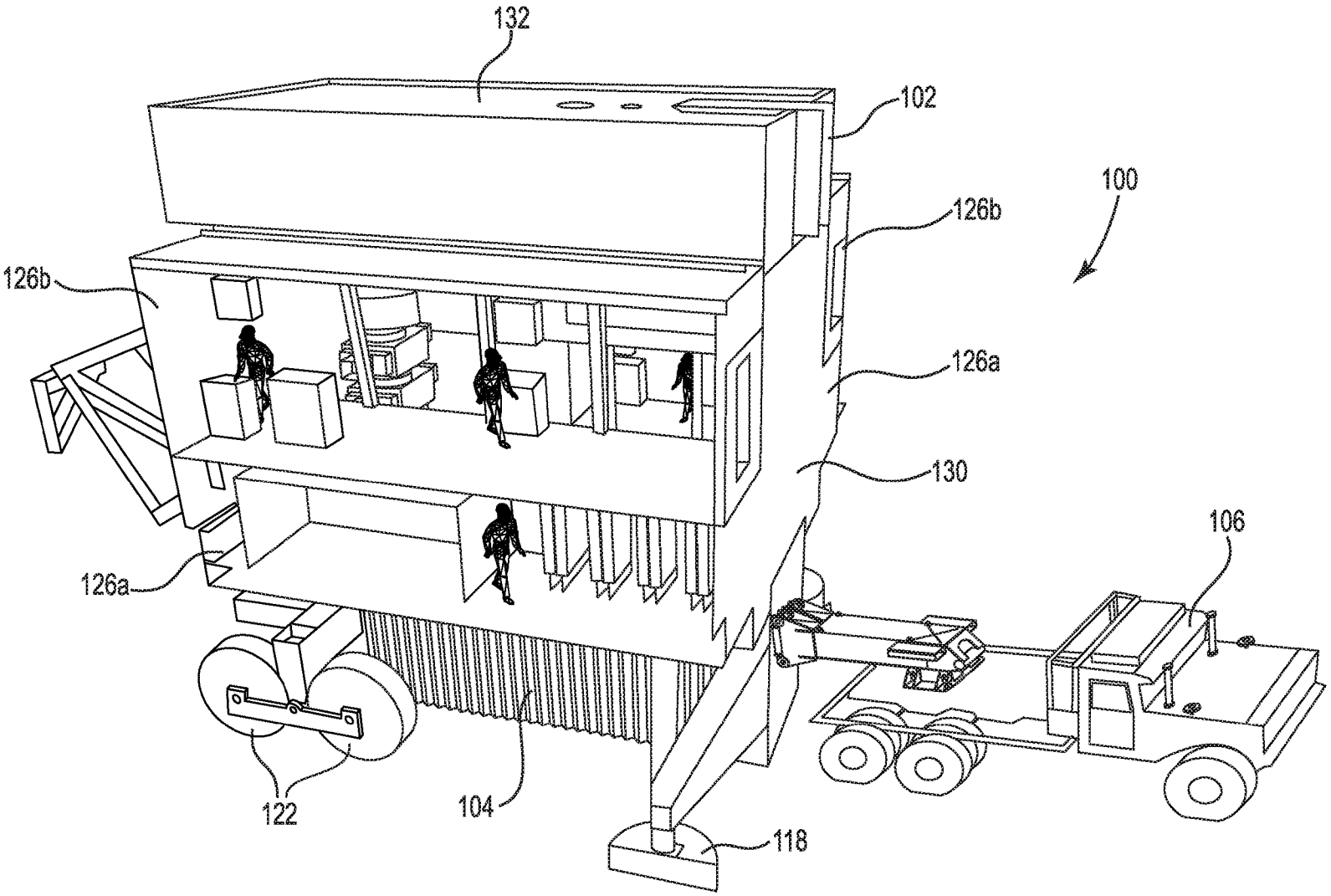
FIG. 13 is a perspective internal view of a cellar trailer of the present disclosure, according to one or more embodiments.
Figure 14:
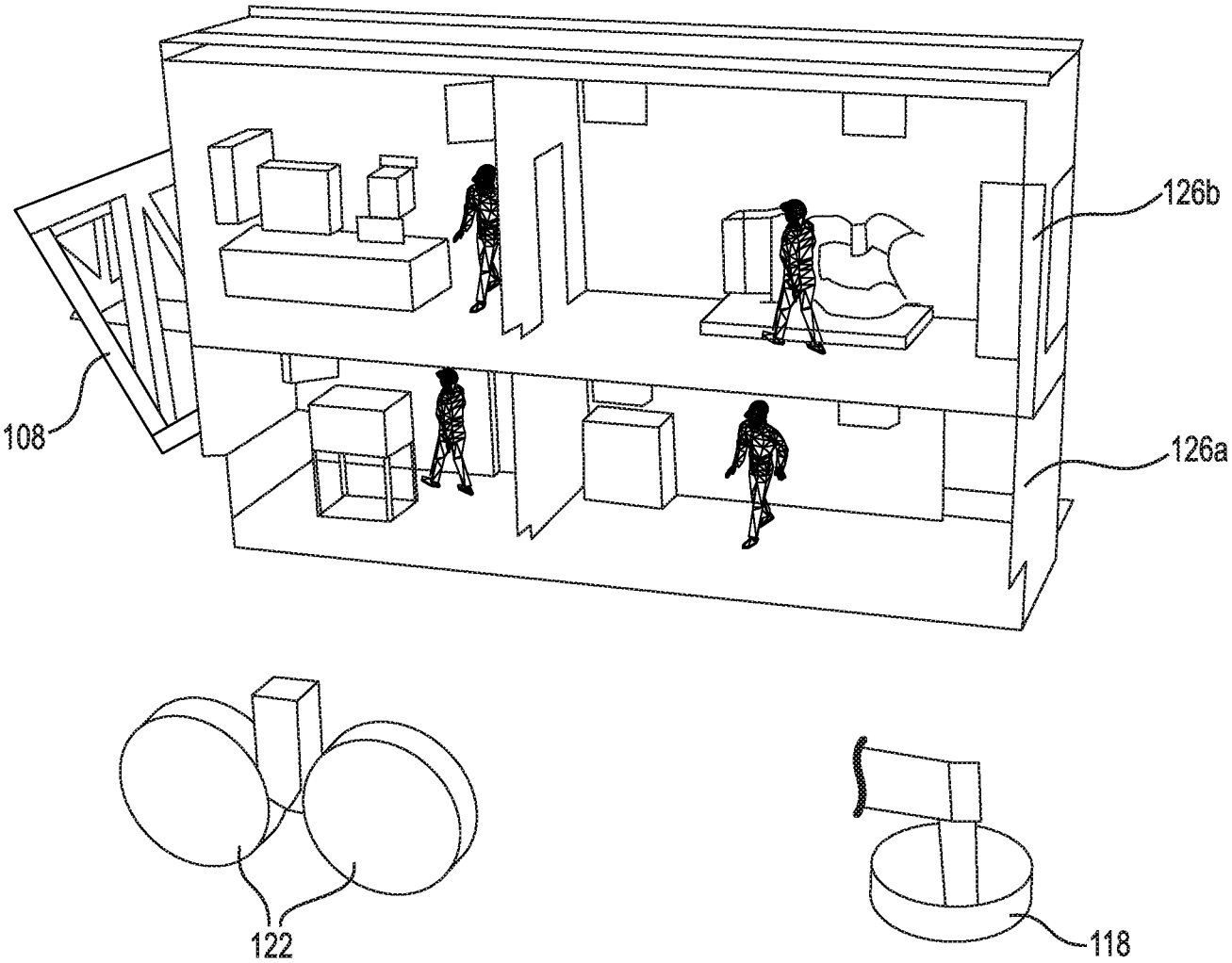
FIG. 14 is an isolated internal view of substructure enclosures of the present disclosure, according to one or more embodiments.

The mezzanine 124 may be configured to house equipment, such as but not limited to, a main blowout preventer 125. The mezzanine 124 may generally have a floor portion 128 arranged on or above the frame 104. The floor portion 128 may be configured to be arranged over the lower cellar area 115 and/or over a well head. In some embodiments, an opening may be arranged in the floor portion 128 to accommodate a well pipe. The mezzanine 124 may additionally have wall portions 130, such as four wall portions, coupled to the floor portion 128 and defining the walls of the mezzanine enclosure. The mezzanine 124 may additionally have a ceiling portion 132 arranged over the mezzanine and coupled to the wall portions 130. The wall portions 130 may extend to a height to arrange the ceiling portion 132 at a height configured to accommodate the main blowout preventer 125 or other drilling equipment. However, the wall portions 130 and ceiling portion 132 may have a height additionally configured to be arranged beneath a drill floor of a drilling rig. The ceiling portion 132 may have an opening configured to accommodate a well pipe. In some embodiments, the mezzanine 124 may be configured to be a sealed or partially sealed enclosure. In some embodiments, the mezzanine 124 may have various hoisting and/or handling mechanisms or equipment. For example, as shown in FIGS. 7 and 9, one or more hoisting mechanisms 134 may be arranged along the ceiling portion 132 in order to hoist the main blowout preventer 125 on and off a well head, and/or for hoisting other equipment. Additionally or alternatively, the mezzanine 124 may have a track along the floor portion 128 and configured to engaged one or more carts for transporting equipment around the well head and/or blowout preventer. In still other embodiments, the mezzanine 124 may include other or additional handling and/or hoisting equipment or mechanisms.

Figure 15:
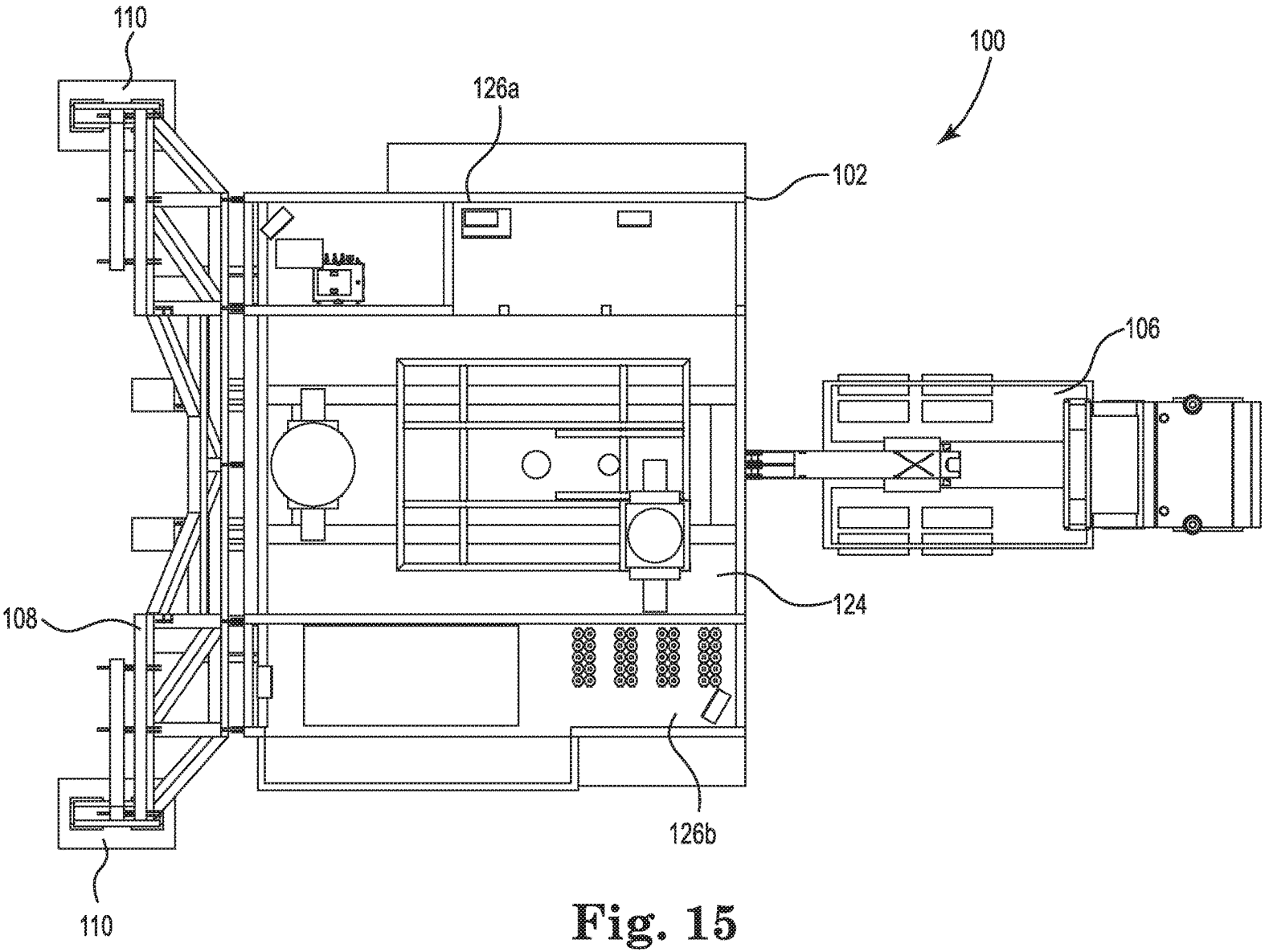
FIG. 15 is an overhead internal view of a cellar trailer of the present disclosure, according to one or more embodiments.
Figure 16:
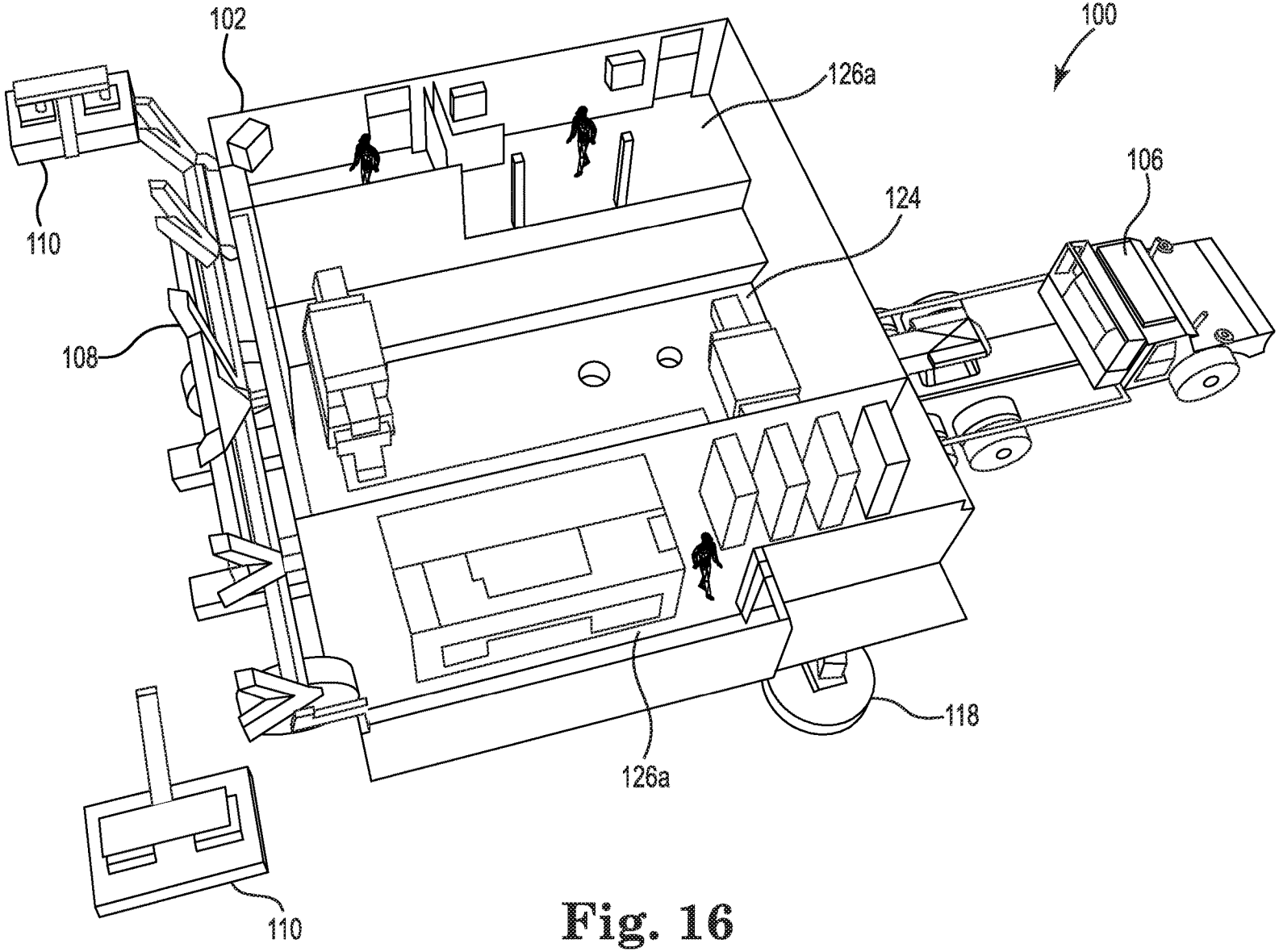
FIG. 16 is a perspective internal view of a cellar trailer of the present disclosure, according to one or more embodiments.
Figure 17:
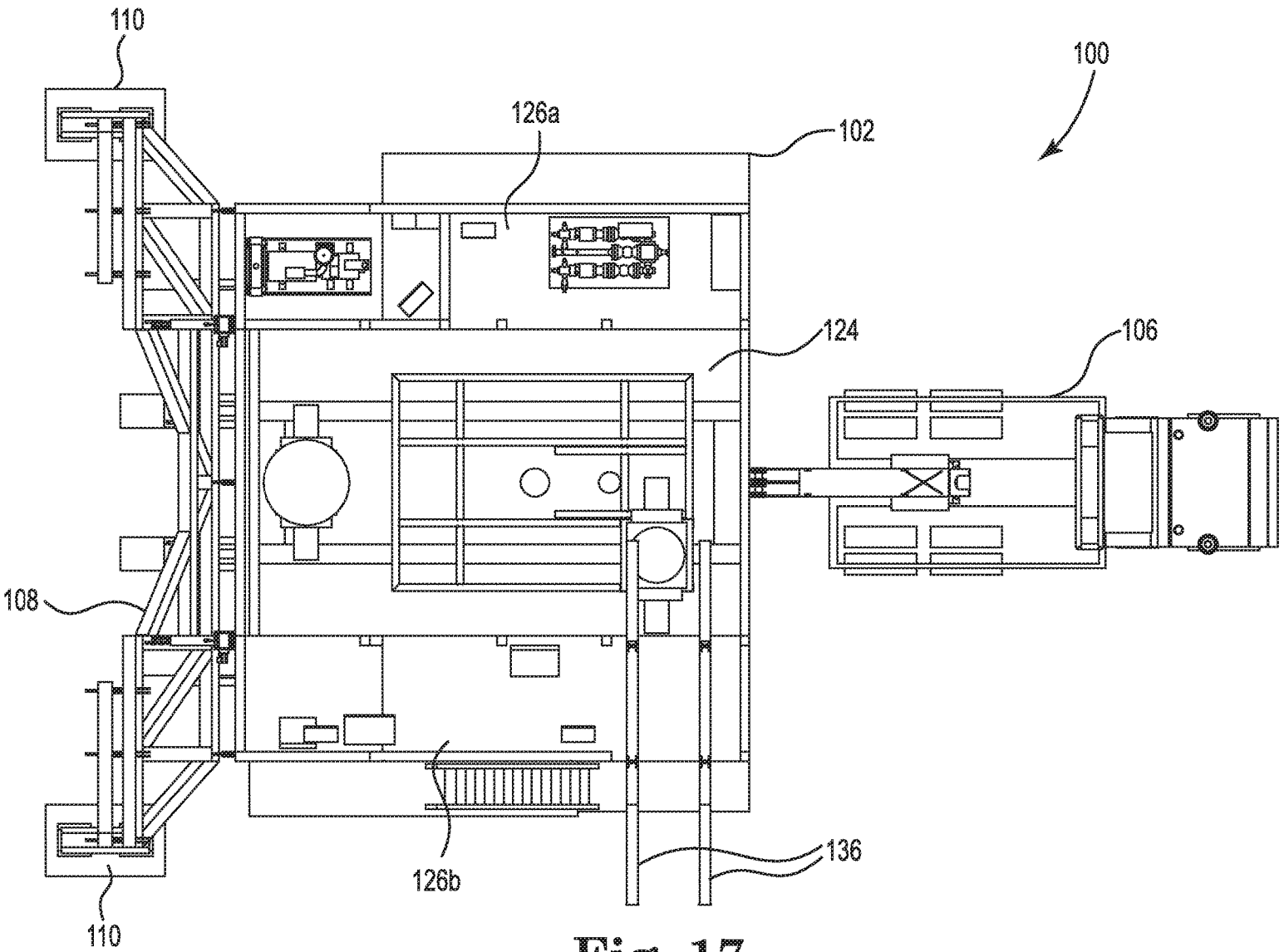
FIG. 17 is another perspective internal view of a cellar trailer of the present disclosure, according to one or more embodiments.
Figure 18:
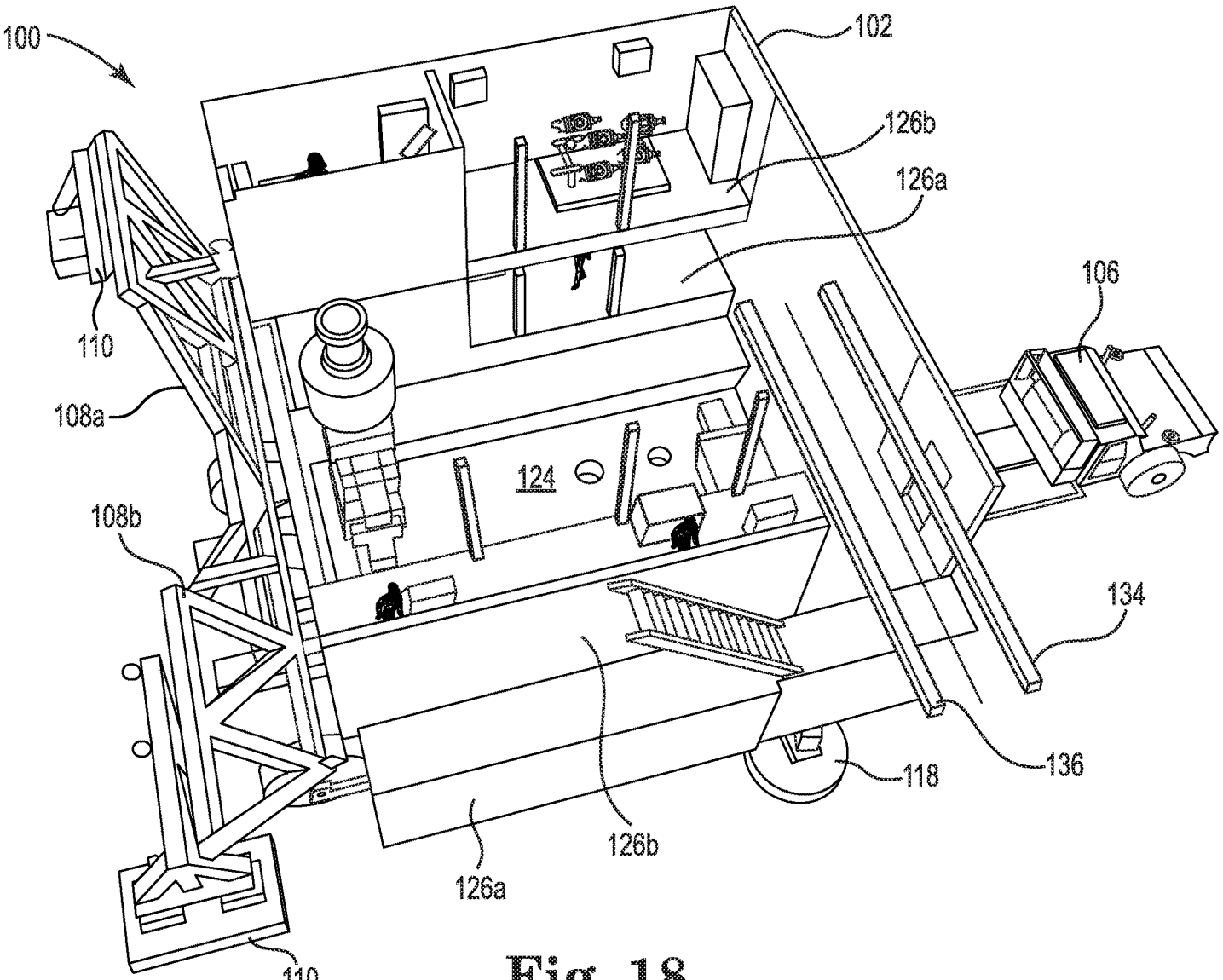
FIG. 18 is another perspective internal view of a cellar trailer of the present disclosure, according to one or more embodiments.
Figure 19:
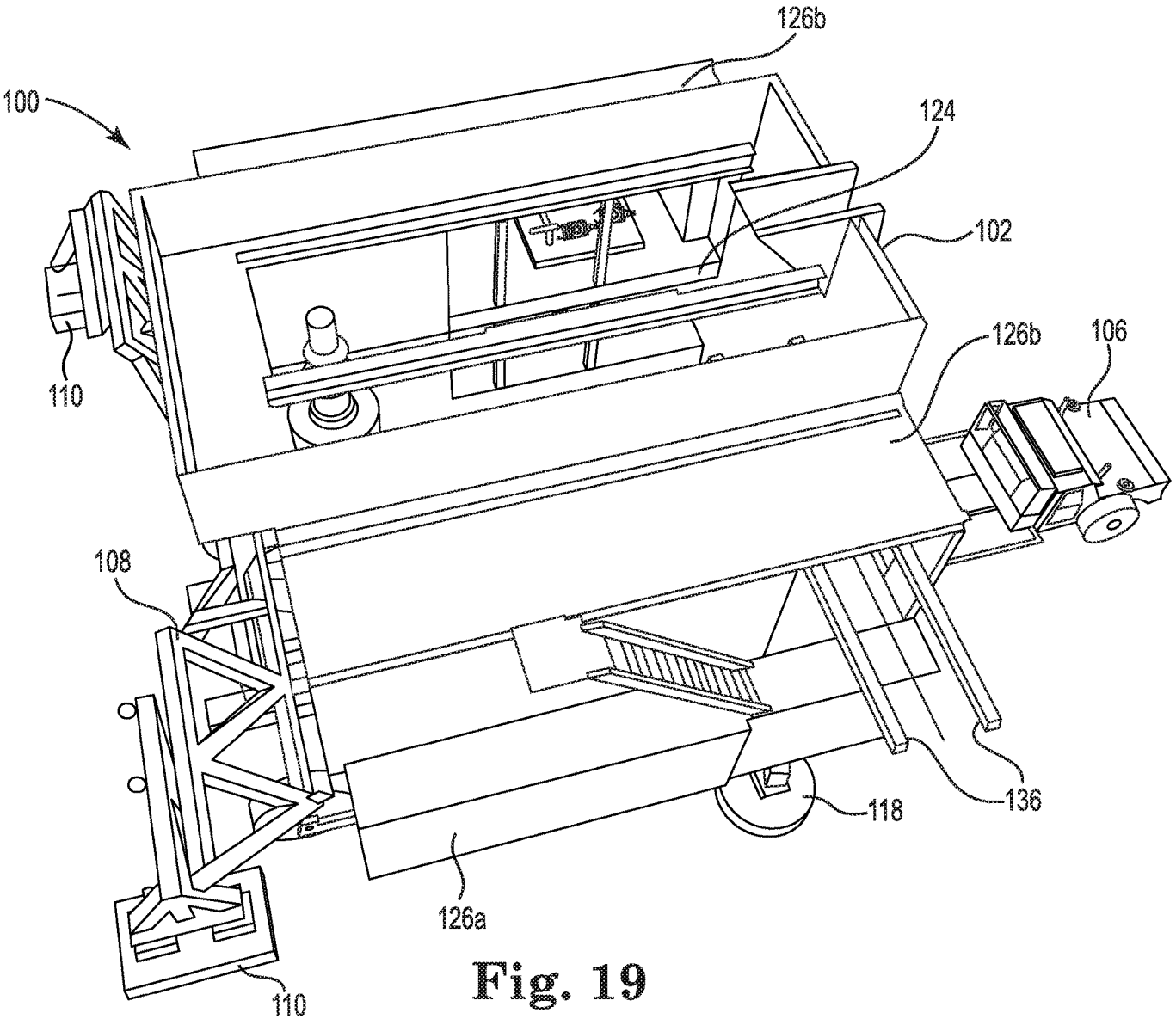
FIG. 19 is another perspective internal view of a cellar trailer of the present disclosure, according to one or more embodiments.
Figure 20:
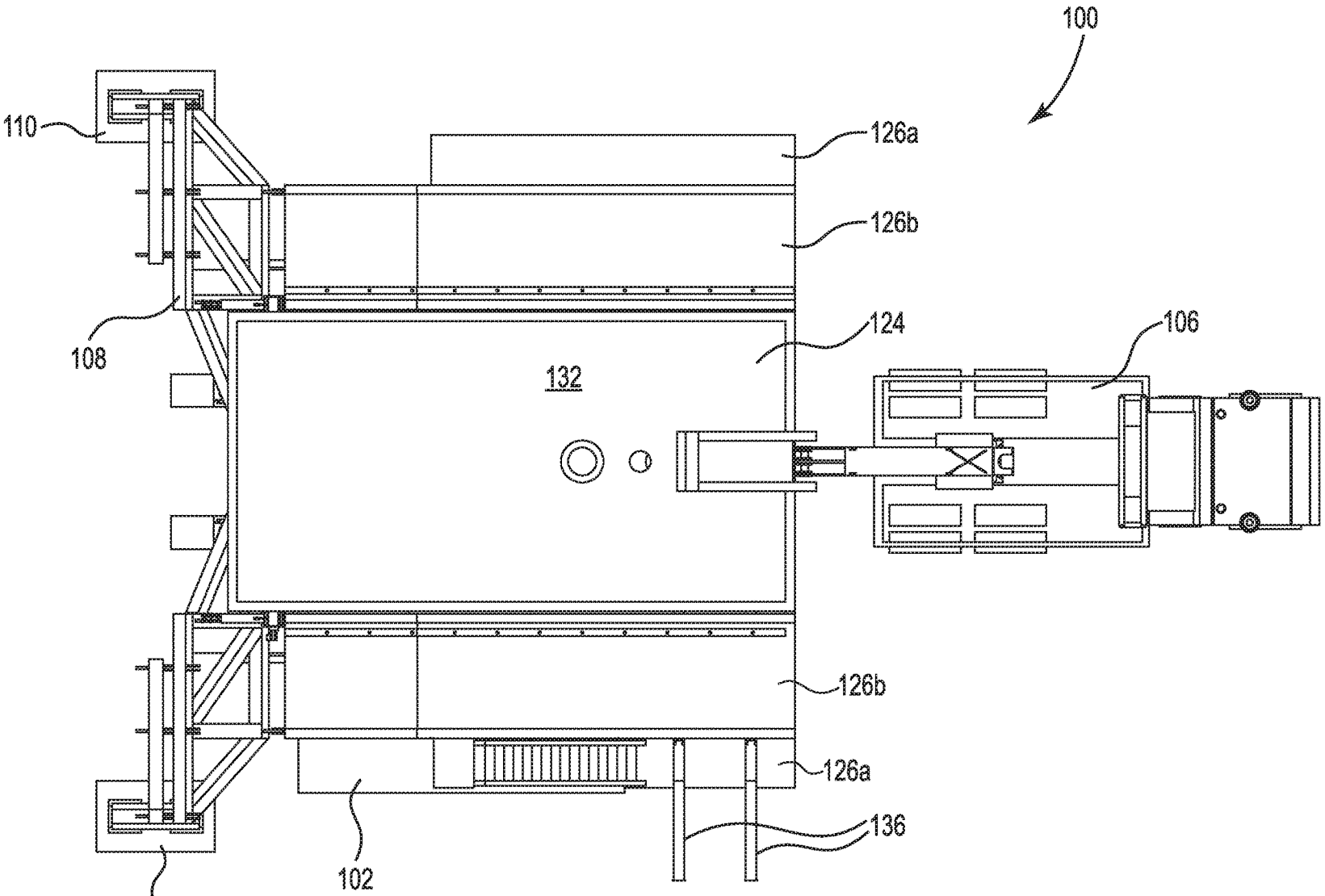
FIG. 20 is an overhead view of a cellar trailer of the present disclosure, according to one or more embodiments.

As shown in FIGS. 7 and 8, one or more subassemblies 126 may be arranged around the mezzanine 124. The subassemblies 126 may include one or more enclosures. For example, one or more subassembly enclosures **126*a*, 126*b* may be arranged adjacent to the mezzanine 124 and along an outside of a wall portion 130 of the mezzanine. In some embodiments, one or more subassembly enclosures 126*a*, 126*b* may be arranged along each of two wall 130 portions of the mezzanine 124. The subassembly enclosures 126*a*, 126*b* may provide additional work areas and/or equipment storage space beyond the mezzanine 124. Each subassembly enclosure 126*a*, 126*b* may be divided into multiple rooms or work or storage areas. In some embodiments, one or more subassembly enclosures 126*a*, 126*b* may be configured to be sealed or partially sealed, and in some cases, may provide a climate controlled or heated environment. In some embodiments, a wall portion 130 of the mezzanine 124 may form an inner wall of the one or more subassembly enclosures 126*a*, 126*b*. In some embodiments, the subassembly enclosures 126*a*, 126*b* may be arranged in a stacked configuration to provide multiple levels of work or storage space. For example, FIGS. 10-14 show various views of a lower level subassembly enclosure 126*a* and an upper level subassembly enclosure 126*b* arranged on each of a driller side and an off-driller size of the mezzanine 124. FIGS. 15 and 16 show the lower level subassembly enclosures 126*a* with respect to the mezzanine 124. As shown, the lower level subassembly enclosures 126*a* may be arranged with floor portions that are at a different height than the floor portion 128 of the mezzanine 124. FIGS. 17 and 18 show the upper level subassembly enclosures 126*b* with respect to the mezzanine 124. In some embodiments, a ceiling portion of one or more lower level subassembly enclosures 126*a* may provide or partially provide a floor portion of one or more upper level subassembly enclosures 126*b*. In some embodiments, the various enclosures may have different sizes. FIGS. 19 and 20 show an additional view of the mezzanine 124 and upper 126*b* and lower 126*a* subassembly enclosures without the ceiling portion 132 or the mezzanine. It may be appreciated that in other embodiments, subassembly enclosures may be arranged differently with respect to one another and/or with respect to the mezzanine 124. For example, the enclosures may be arranged to provide only one level or more than two levels. In some embodiments, subassembly enclosures may be arranged on more, fewer, or different wall portions 130 of the mezzanine 124 than those shown in FIGS. 7-20**.

In some embodiments, one or more crane rails 136 may extend through an opening of the housing 102 in order to provide means for moving equipment into and out of the housing. For example, as shown in FIG. 9, one or more crane rails 136 may extend from the mezzanine 124, through a wall portion 130 on a driller or off-driller side, and through a subassembly enclosure 126*a*, 126*b*, to extend beyond the housing 102. This may allow workers to move equipment to and from the mezzanine 124 from outside of the trailer 100. In other embodiments, other handling and/or hoisting equipment or other mechanisms may be used to transport equipment to and from the housing 102. FIGS. 17-20 additionally show the crane rails 136.

In some embodiments, the housing 102 may be configured to couple to a drill floor of a drilling rig. That is, the ceiling portion 132 of the mezzanine 124, for example, may be configured to abut an underside of the drill floor when the trailer 100 is arranged beneath the drill floor. In this way, the ceiling portion 132, or another component arranged thereon, may have a relatively flattened surface configured to receive and/or abut the drill floor. Additionally, the housing 102 may be configured to couple to the drill floor via one or more hydraulic pins and/or other suitable coupling mechanisms. In some embodiments, the ceiling portion 132 of the mezzanine may operate as a drip pan when beneath the drill floor.

Figure 21:
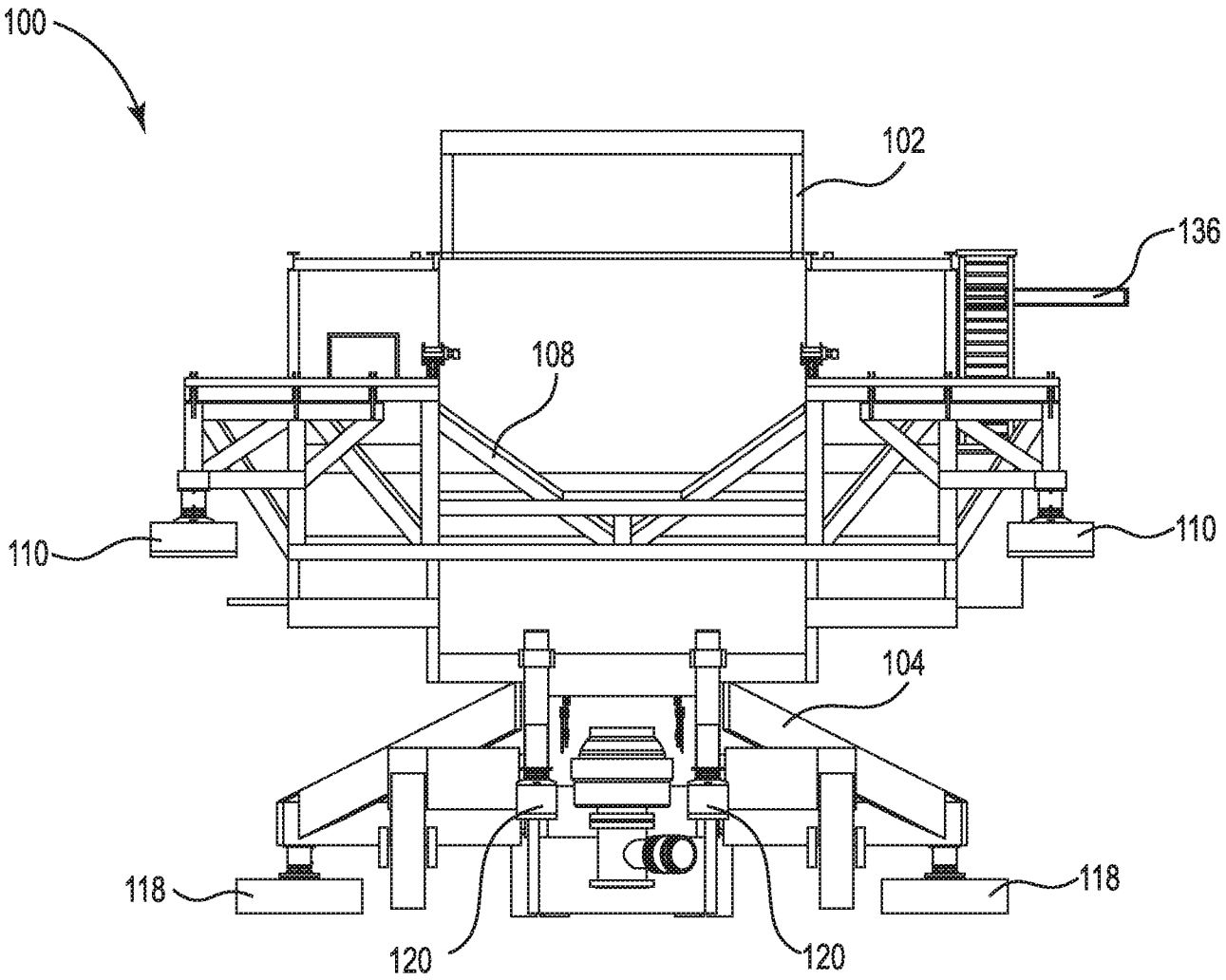
FIG. 21 is a rear end view of a cellar trailer of the present disclosure, according to one or more embodiments.

In some embodiments, the cellar trailer 100 may have a shear wall 108, such as a truss shear wall, configured to extend between the trailer and a ground or pad surface in order to provide stiffening support to the drill floor above the trailer during drilling operations. The shear wall 108 is shown, for example, in FIG. 21 (see also FIG. 3). The shear wall may be comprised of a plurality of trusses in some embodiments. The shear may couple to the housing 102 or to another portion of the trailer 100 and may be configured to extend between the trailer and a ground or pad surface. In some embodiments, the shear wall 108 may extend from a rear end of the trailer 100, opposite the tow end of the trailer, and may extend rearward from the trailer. The wall 108 may have a width spanning across the width of the housing 102 or trailer 100, or a portion thereof. The shear wall 108 may have a height configured to extend between its point of attachment to the housing 102 or trailer 100 and the ground or pad surface. It may be appreciated that the shear wall 108 may be configured to be used in place of conventional stiffening legs in order to support the drill floor during drilling operations in some embodiments. The shear wall 108 may be configured to be arranged in more than one position, such as a roading position and a drilling position. In the roading position, as shown in FIG. 21, the wall 108 may be configured to fold and/or pivot upward away from the ground or pad surface. In the drilling position, the wall 108 may fold and/or pivot downward such that it may be arranged between the trailer 100 and ground or pad surface. The wall 108 may be configured such that, when arranged in the drilling position, it may accommodate or arch over the inner bearing feet 120, tires 122, and/or other equipment. In this way, the shear wall 108 may be configured to have a width extending beyond the inner bearing feet 120, tires 122, and/or other equipment. In some embodiments, the wall 108 may have two portions, such as a driller side portion and an off-driller side portion that may be configured to pivot and/or fold independently of one another. FIG. 18, for example, shows a first portion 108*a* of the shear wall arranged in a roading position and a second portion 108*b* of the shear wall arranged in a drilling position. In some embodiments, the wall 108 may have one or more bearing pads 110. For example, each portion 108*a*, 108*b* of the wall may have a bearing pad 110. In other embodiments, the shear wall 108 may have a single bearing pad, or any other suitable number of bearing pads.

Figures 22A, 22B, 22C, 22D, 22E, 22F:
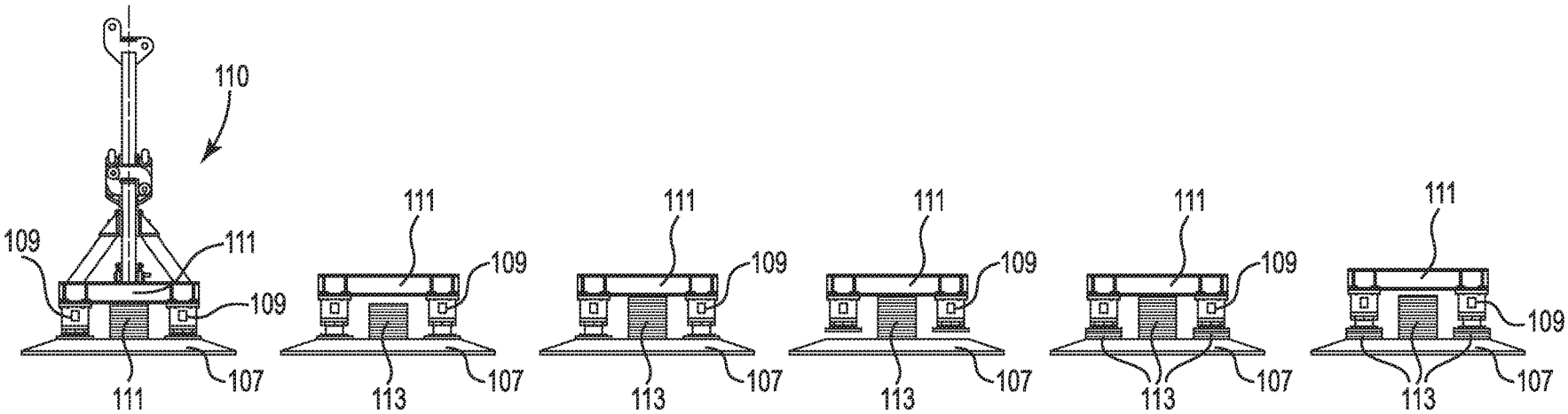
FIG. 22A is a side view of a shear wall bearing pad of the present disclosure with plates arranged beneath the bearing pad, according to one or more embodiments.
FIG. 22B is another side view of the bearing pad of FIG. 22A, with hydraulic cylinders extended, according to one or more embodiments.
FIG. 22C is another side view of the bearing pad of FIG. 22A, with additional plates arranged beneath the pad, according to one or more embodiments.
FIG. 22D is another side view of the bearing pad of FIG. 22A, with hydraulic cylinders retracted, according to one or more embodiments.
FIG. 22E is another side view of the bearing pad of FIG. 22A, with plates arranged beneath the hydraulic cylinders, according to one or more embodiments.
FIG. 22F is another side view of the bearing pad of FIG. 22A, with hydraulic cylinders extended, according to one or more embodiments.

Each bearing pad 110 may be configured to transfer load from the drill floor, through the shear wall 108, and to the ground or pad surface. In some embodiments, the bearing pads 110 may each be hydraulically coupled to the shear wall 108 via one or more hydraulic cylinders. In this way, each bearing pad 110 may be extended or retracted with respect to the shear wall 108. This may help to span the length between the trailer 100 and ground or pad surface. In some embodiments plates, such as steel plates may be arranged beneath the bearing pads 110. For example, FIG. 22A shows a bearing pad 110 having two hydraulic cylinders 109, and a plurality of steel plates 113 arranged beneath a center portion 111 of the bearing pad. In the event that the pad or ground surface experiences settlement during drilling operations, the hydraulically controlled bearing pads 110 and steel plates 113 may help to shim the space between the ground or pad surface and the bearing pads. FIGS. 22A-22F illustrate a series of steps in shimming space between a ground or pad surface 107 and a bearing pad 110. As shown in FIG. 22B, if the space between the ground or pad surface 107 and bearing pad 110 increases such as due to settlement, one or more hydraulic cylinders 109 of the bearing pad 110 may be extended. As shown in FIG. 22C, one or more additional steel plates 113 may be arranged beneath a center portion 111 of the bearing pad 110. As shown in FIG. 22D, the one or more hydraulic cylinders 109 may be retracted. As shown in FIG. 22E, one or more additional steel plates 113 may be arranged beneath the hydraulic cylinders 109. If settlement proceeds further, as shown in FIG. 22F, the one or more hydraulic cylinders 109 may be extended, such that additional steel plates 113 may be arranged beneath the center portion 111 of the bearing pad 110.

In use, a cellar trailer 100 of the present disclosure may be configured to support and house blowout preventer(s) and/or other well head equipment or other drilling equipment during drilling operations. It may be appreciated that the equipment supported by and housed within the cellar trailer 100 may weigh tens or hundreds of thousands of pounds. In a conventional drilling operation, this equipment is stored on or supported by the drilling rig itself. By housing such equipment in a separate modular cellar trailer, the drilling rig is made significantly lighter when the two are separated for transport. In some embodiments, the cellar trailer 100 may support and house up to half the equipment load conventionally stored on the rig. The lighter rig may more readily conform to desired tire capacities or other weight limits or loading capacities. Moreover, the lighter rig may provide for safer conditions when driven over ice roads. In some embodiments, the cellar trailer 100 may additionally help to transfer loading from drilling operations to the ground. The cellar trailer 100 may additionally provide stiffening support to the drill floor by way of the shear wall 108. In this way, it may be appreciated that stiffening legs conventionally used to support the drill floor may not be needed, further reducing weight or load on the drill rig.

Figure 23:
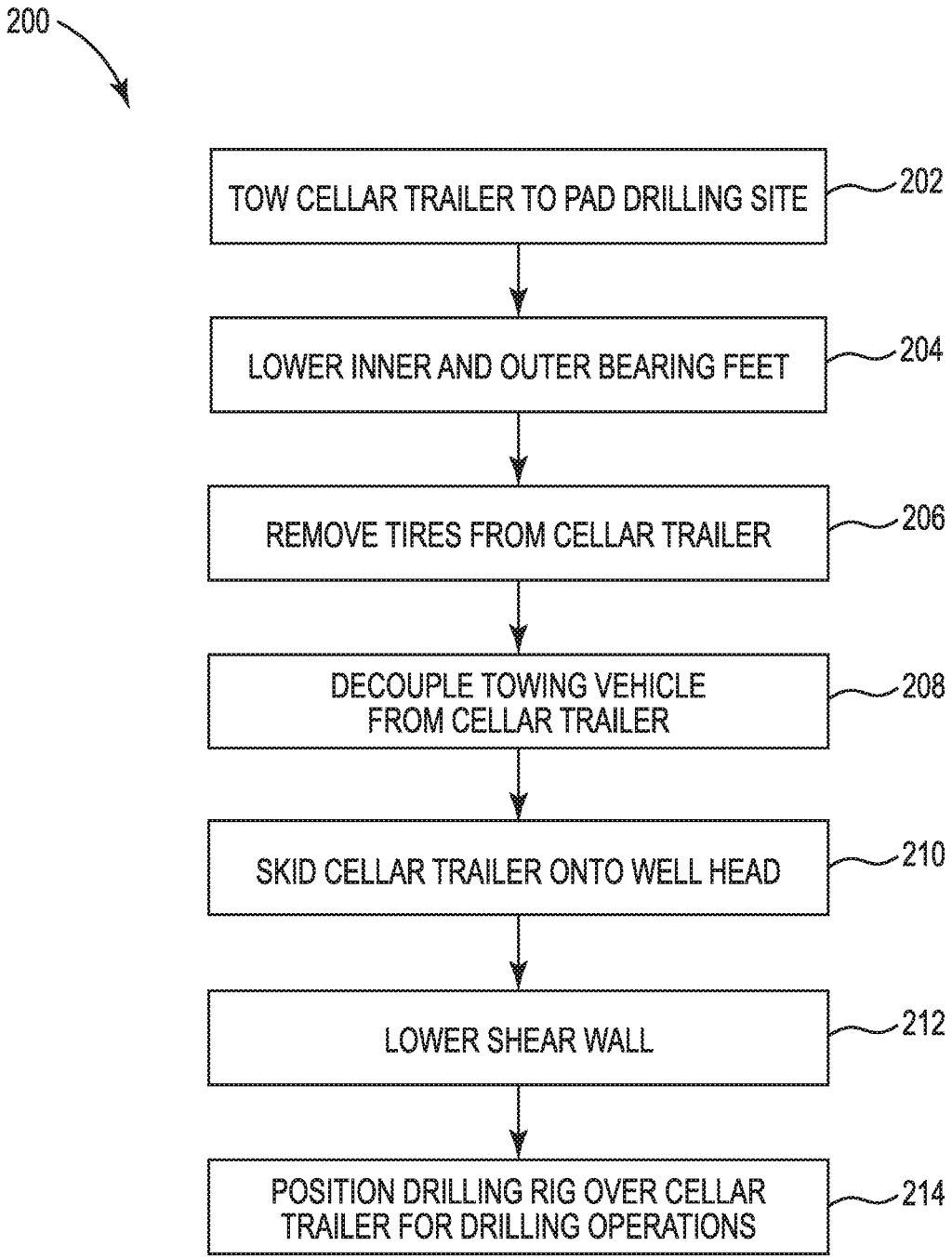
FIG. 23 is a flow diagram of a method of using a cellar trailer of the present disclosure, according to one or more embodiments.

FIG. 23 illustrates a method 200 of using a cellar trailer of the present disclosure, according to one or more embodiments. The method 200 may include towing the cellar trailer to a drilling site (202); lowering the inner and outer bearing feet (204); removing the tires from the trailer (206); decoupling the trailer from the towing vehicle (208); skidding the trailer onto a well head (210); lowering the shear wall (212); and positioning a drilling rig over the cellar trailer for drilling operations (214).

Figure 24:
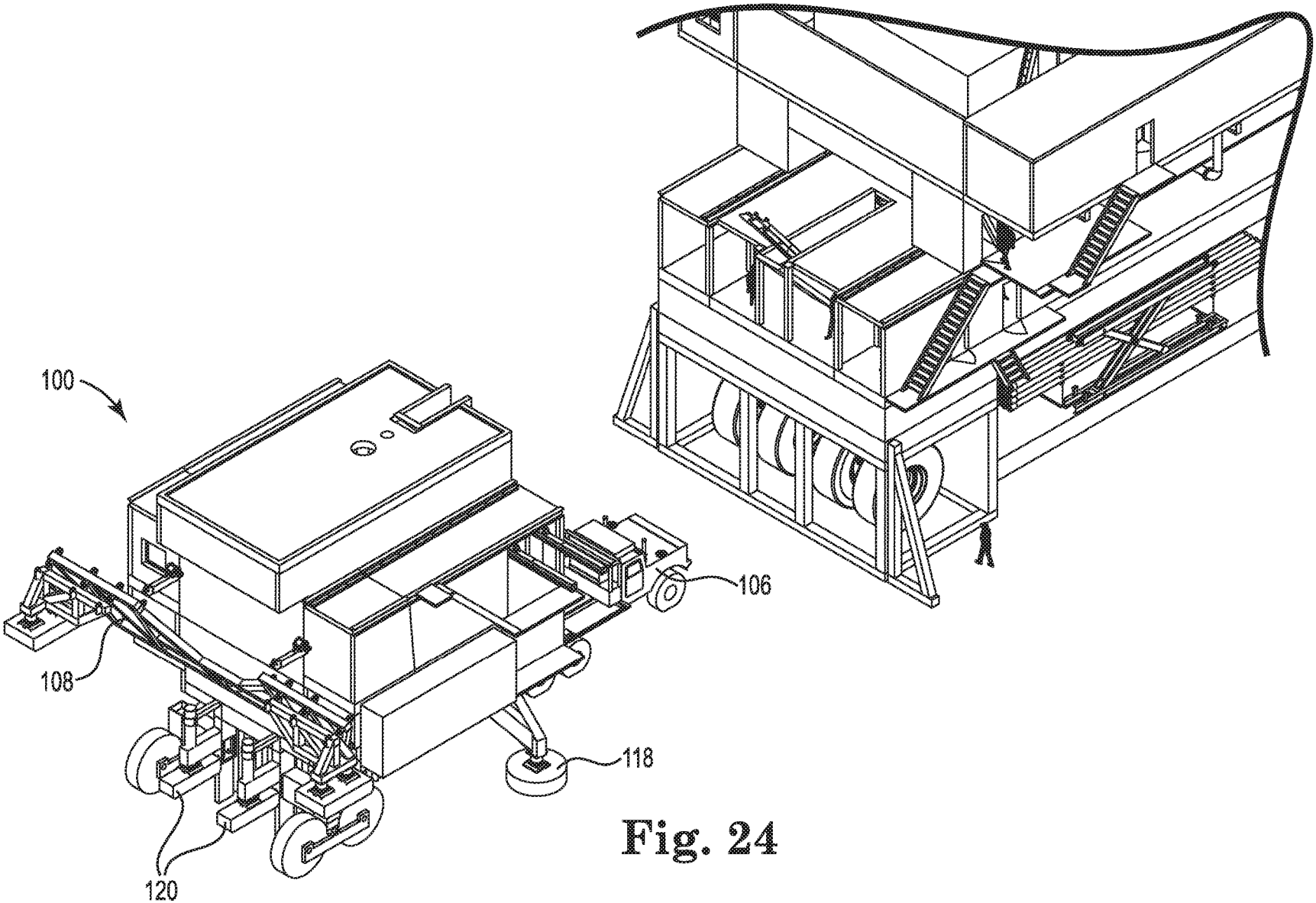
FIG. 24 is a perspective view of a cellar trailer of the present disclosure, according to one or more embodiments.

Towing the cellar trailer to a drilling site (202) may include coupling the trailer 100 to a towing vehicle 106, such as a truck or tractor, via the hitch 112. The trailer 100 may be towed to a drilling site, such as a pad drilling site having one or more well heads. While the trailer 100 is being towed, the bearing feet 118, 120, shear wall 108, and/or other equipment may be in a roading position. FIG. 24 illustrates the trailer 100 with inner and outer bearing feet 120, 118 and shear wall 108 in a roading position, and coupled to a towing vehicle 106 for towing. It may be appreciated that in other embodiments, the trailer 100 may have its own drive system, such that it may be independently drivable without the need for a towing vehicle.

Figure 25:
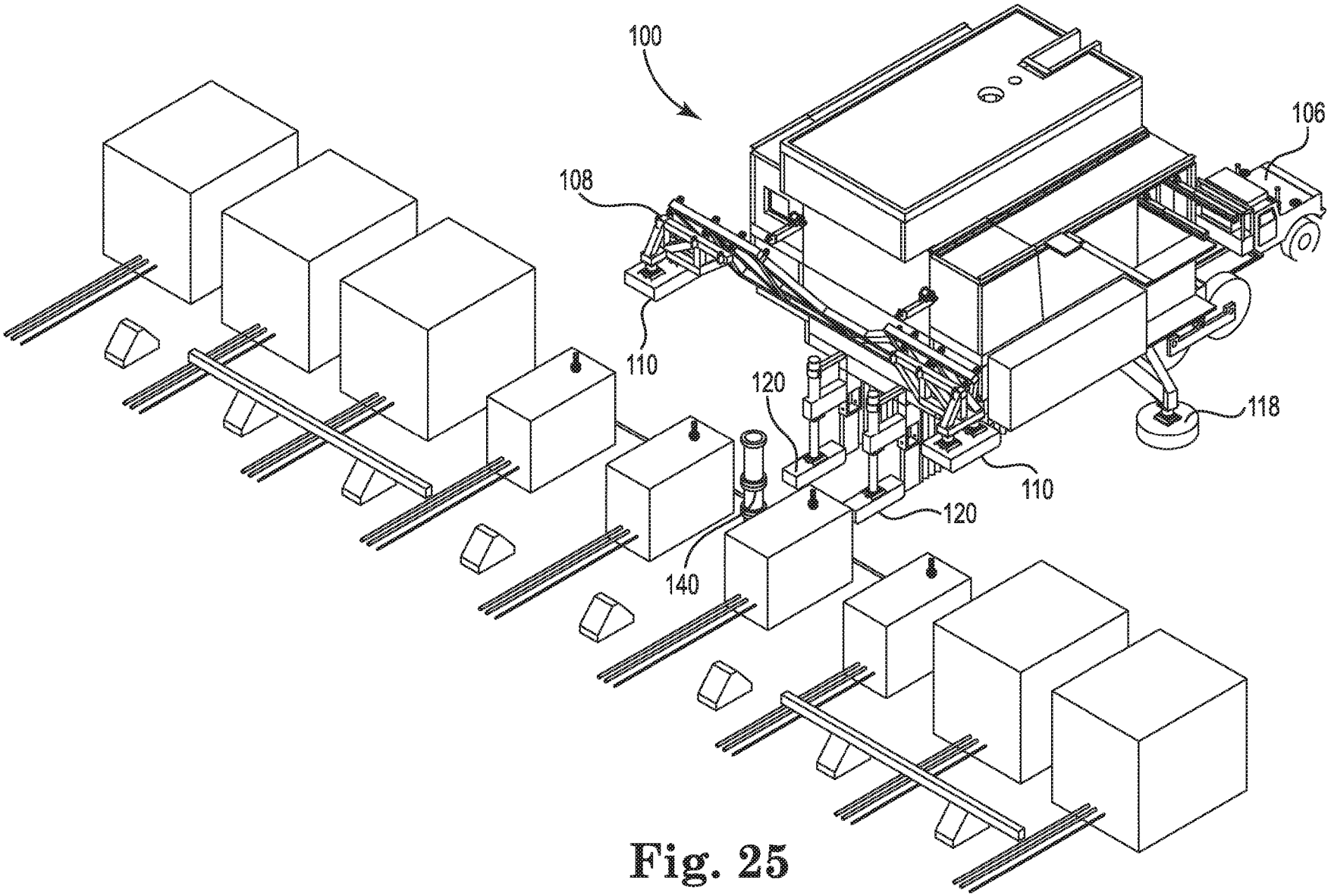
FIG. 25 is a perspective view of a cellar trailer of the present disclosure being towed to a well head and in a drilling position, according to one or more embodiments.

Once at a drilling site and near a well head, the trailer 100 may be prepared for skidding onto the well head, as shown in FIG. 25. For example, the inner 120 and outer 118 bearing feet may be lowered to the ground level (204). In some embodiments, the tires 122 may be removed from the trailer 100 (206). The trailer 100 may be decoupled from the towing vehicle 106 (208). This may include, for example, using the inner 120 and outer 118 bearing feet to jack the trailer 100 up, so as to allow the hitch 112 to be decoupled from the towing vehicle 106.

Once on the inner 120 and outer 118 bearing feet, the trailer 100 may be walked or skidded onto a well head 140 (210) using walking feet or another other movement mechanism(s). The trailer 100 may be positioned on the well head 140 such that the well head is positioned in the lower cellar area 115 of the trailer.

Figure 26:
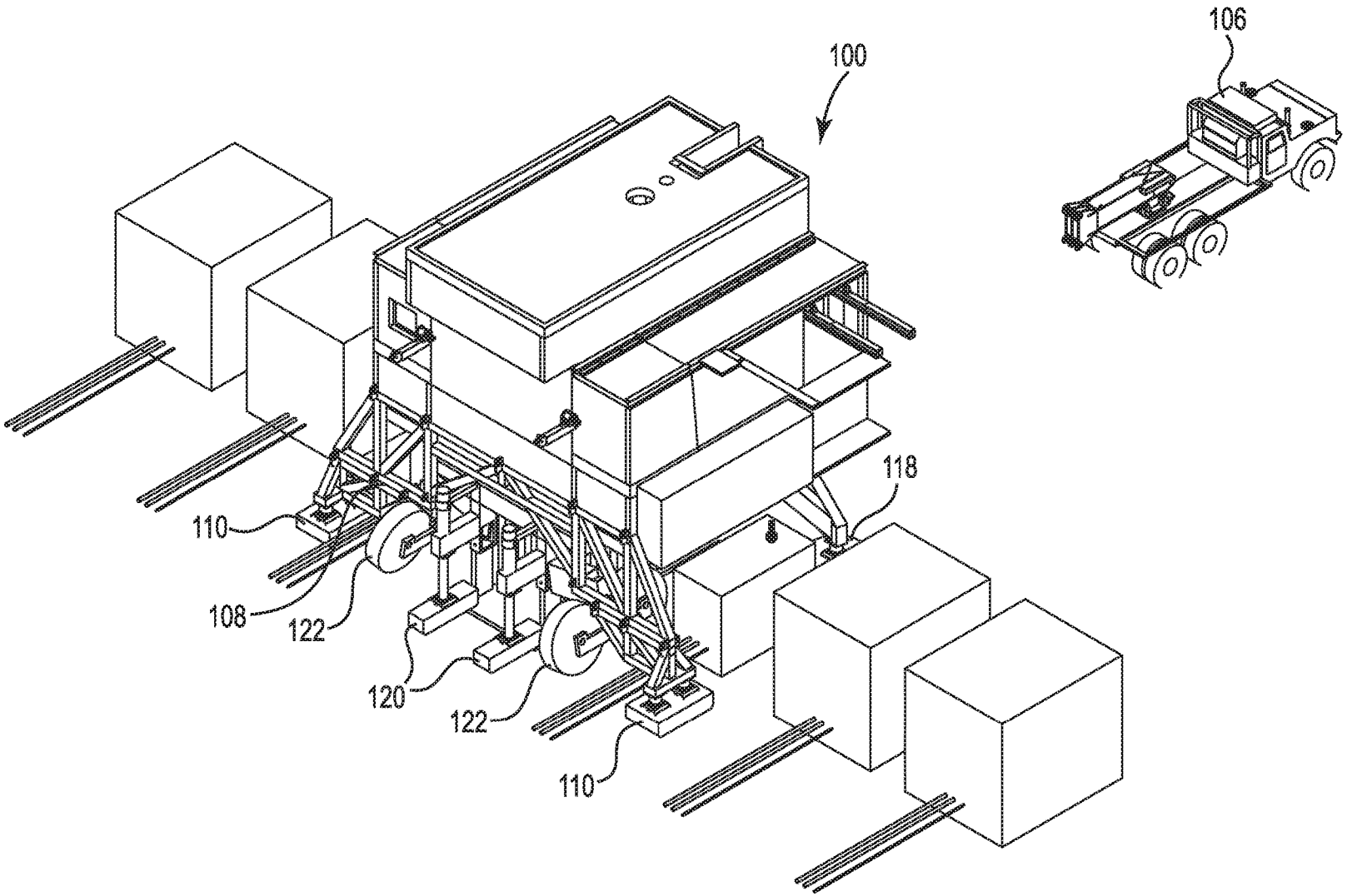
FIG. 26 is a perspective view of a cellar trailer of the present disclosure arranged over a well head.

In addition, the shear wall 108 may be lowered to the drilling position (212). As shown in FIG. 26, the shear wall 108 may be lowered and/or unfolded to positioned the bearing pads 110 on the ground or pad surface, such that the wall extends between the ground or pad surface and the trailer 100. It may be appreciated that the shear wall 108, bearing pads 110, and/or other components of the trailer 100 may be sized and arranged to accommodate any production piping 138 with respect to a well site.

Figure 27:
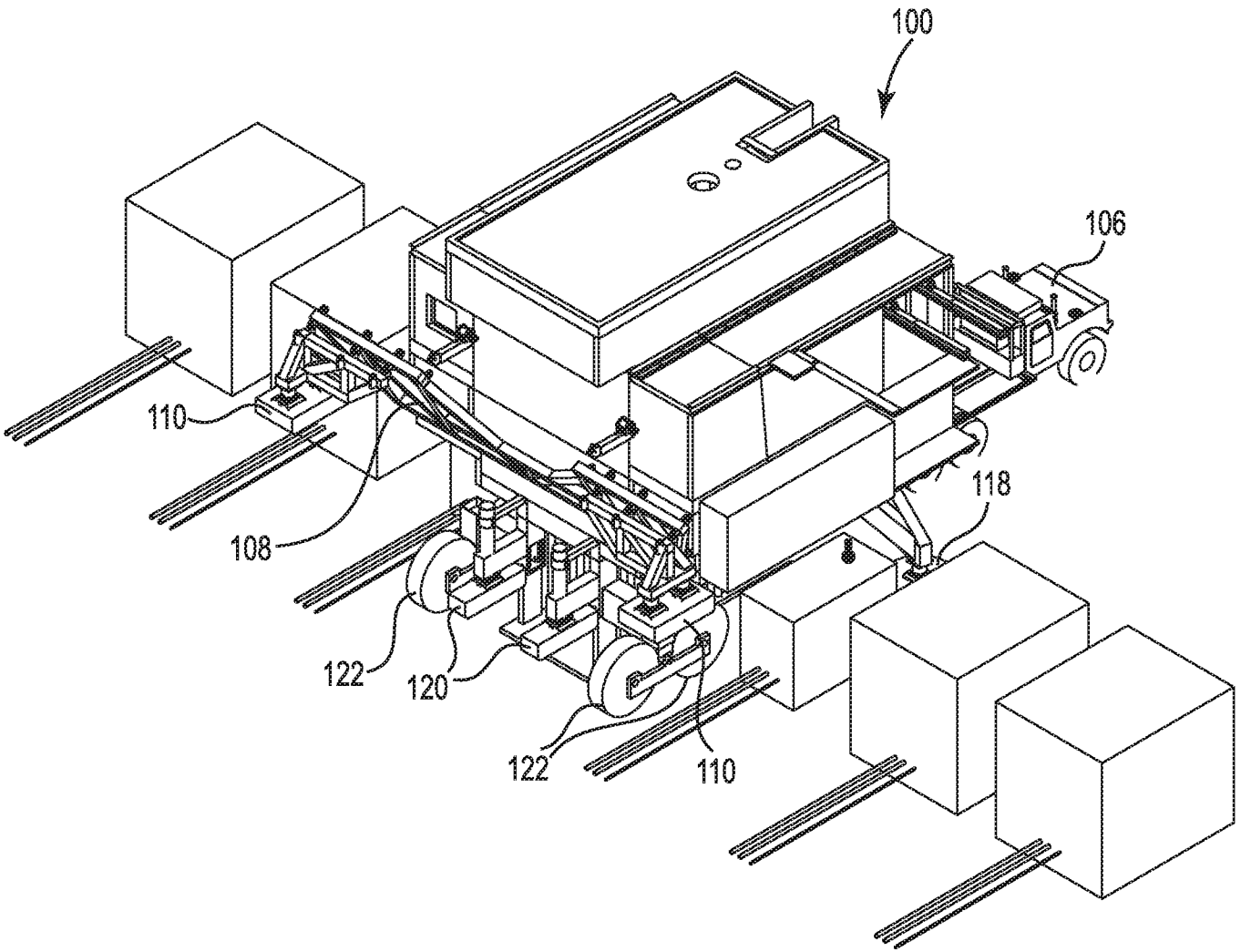
FIG. 27 is another perspective view of a cellar trailer of the present disclosure arranged over a well head and in a roading position, according to one or more embodiments.

In other embodiments, rather than skidding the trailer onto the well head 140, the trailer 100 may be towed (pushed) onto the well head using the towing vehicle 106, as shown in FIG. 27. In such cases, the inner 120 and outer 118 bearing feet and shear wall 108 may be lowered, and the towing vehicle 106 may be decoupled, after the trailer 100 is in position on the well head 140. The method (skidding or towing) used to position the trailer 100 on the well head 140 may depend in part on spacing surrounding the well head. For example, on a multi-well pad drilling site, limited space between wells may be such that towing or driving the trailer onto the well head 140 may be cumbersome or not feasible, and skidding operations may be more applicable.

In general, the trailer 100 may be arranged on the well head 140 before the drilling rig is in place. This may allow workers to begin testing the blowout preventer(s) and/or other equipment, and generally preparing the well head 140 for drilling operations before the drill rig arrives. It may be appreciated that this may help speed the drilling process with respect to the drill rig, at least because the well head 140, blowout preventer(s), and/or other equipment may already be prepared for drilling when the drill rig arrives at the drill site. The drill rig may be positioned over the well head 140 and over the trailer 100 (214), such that the drill floor may abut the trailer. The trailer 100 may be coupled to the drill rig via hydraulic pins or other suitable coupling mechanisms.

It may be appreciated that the steps of the method 200 may be generally reversed to remove the trailer 100 from the well head 140, such as after drilling operations are completed. For example, after drilling operations at the well are completed, the drilling rig may be decoupled from the trailer 100 and removed from the well site. The shear wall 108 may be raised. If the trailer 100 was towed onto the well head 140, the towing vehicle 106 may be coupled to the trailer 100, the bearing feet 118, 120 raised, and the trailer may be towed off of the well head. If, however, the trailer 100 was skidded onto the well head 140, the trailer may be skidded off of the well head via walking feet or other mechanisms. The trailer 100 may then be coupled to the towing vehicle 106, the tires 122 may be replaced if they were removed, and the bearing feet 118, 120 may be raised. The trailer 100 may be towed to a different well site or, in some embodiments, to a different well on the pad.

Figure 28:
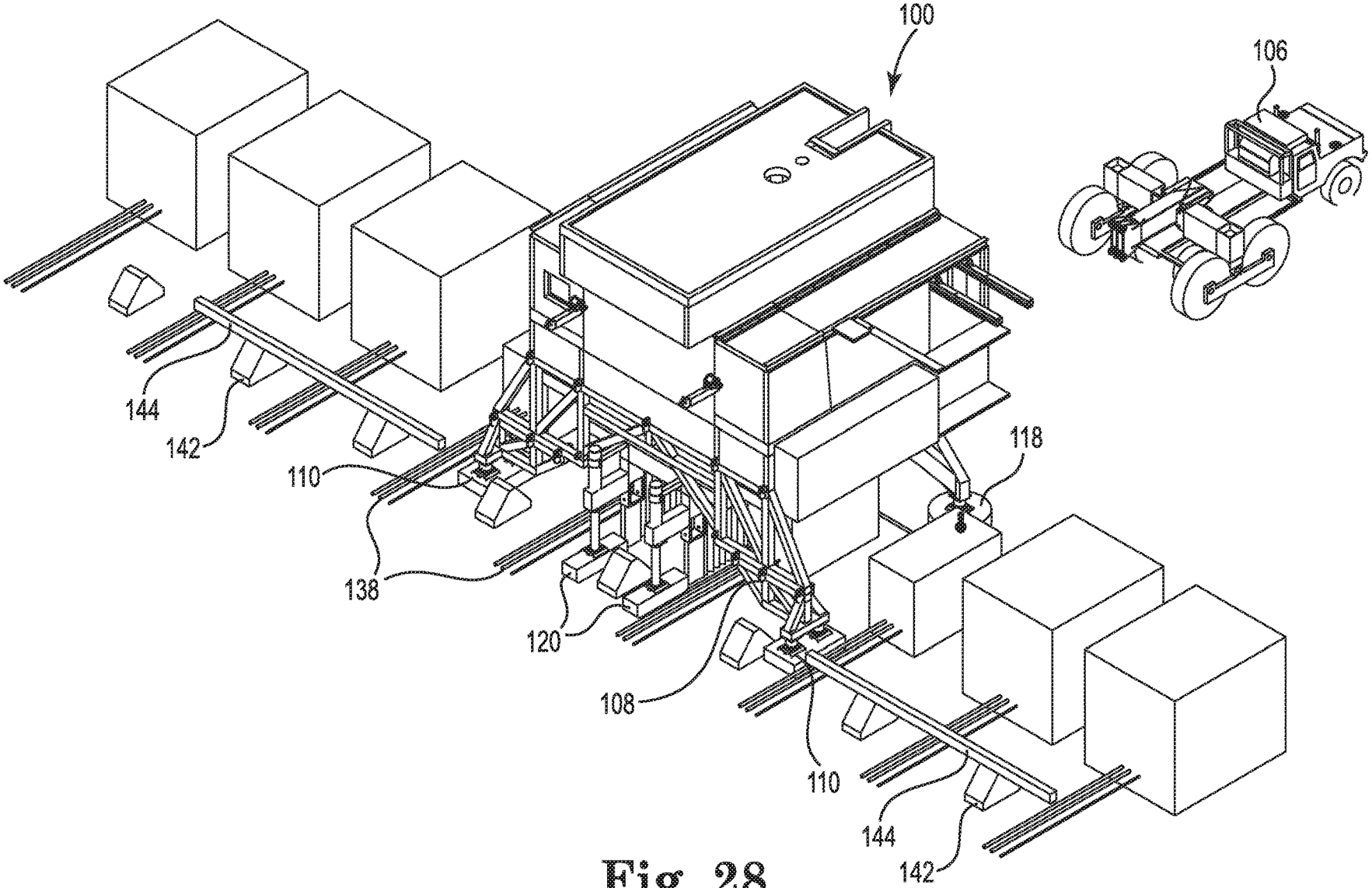
FIG. 28 is a perspective view of a cellar trailer of the present disclosure arranged over a well head and in a drilling position, according to one or more embodiments.
Figure 29:
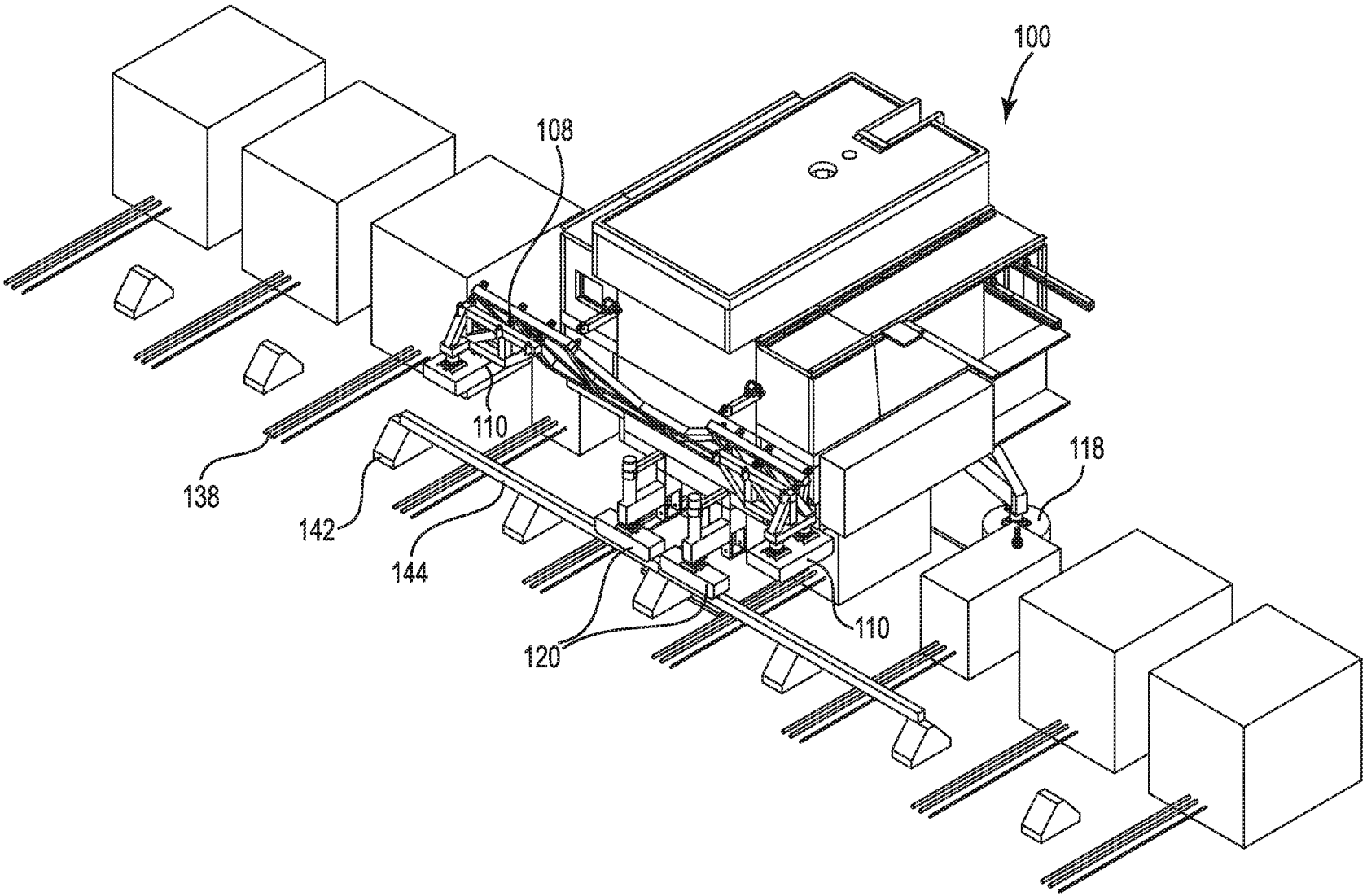
FIG. 29 is a perspective view of a cellar trailer of the present disclosure arranged over a well head and in a skidding position, according to one or more embodiments.

In some embodiments, a cellar trailer 100 of the present disclosure may be configured to skid perpendicular to a direction of towing travel. For example, on a multi-well pad drilling site, the trailer 100 may be configured to skid along a row of wells in order to efficiently move along the row of well heads. Turning to FIG. 28, in some embodiments, a modular rail comprising a plurality of rail sections 144 may be arranged on the production piping 138 side of a row of well heads. In some embodiments, the rail sections 144 may be arranged on and supported by a plurality of sawhorses 142 configured to support the rail above the production piping 138, or generally above the ground or pad surface. The modular rail sections 144 may be pinned together and/or pinned to the sawhorses 142. To move to a next well in the row of wells, the inner bearing feet 120 may be arranged on the rail, the shear wall 108 may be raised, and the trailer 100 may be skidded, via walking feet or another mechanism(s), to a next well in the row, as shown in FIG. 29.

Figure 30:
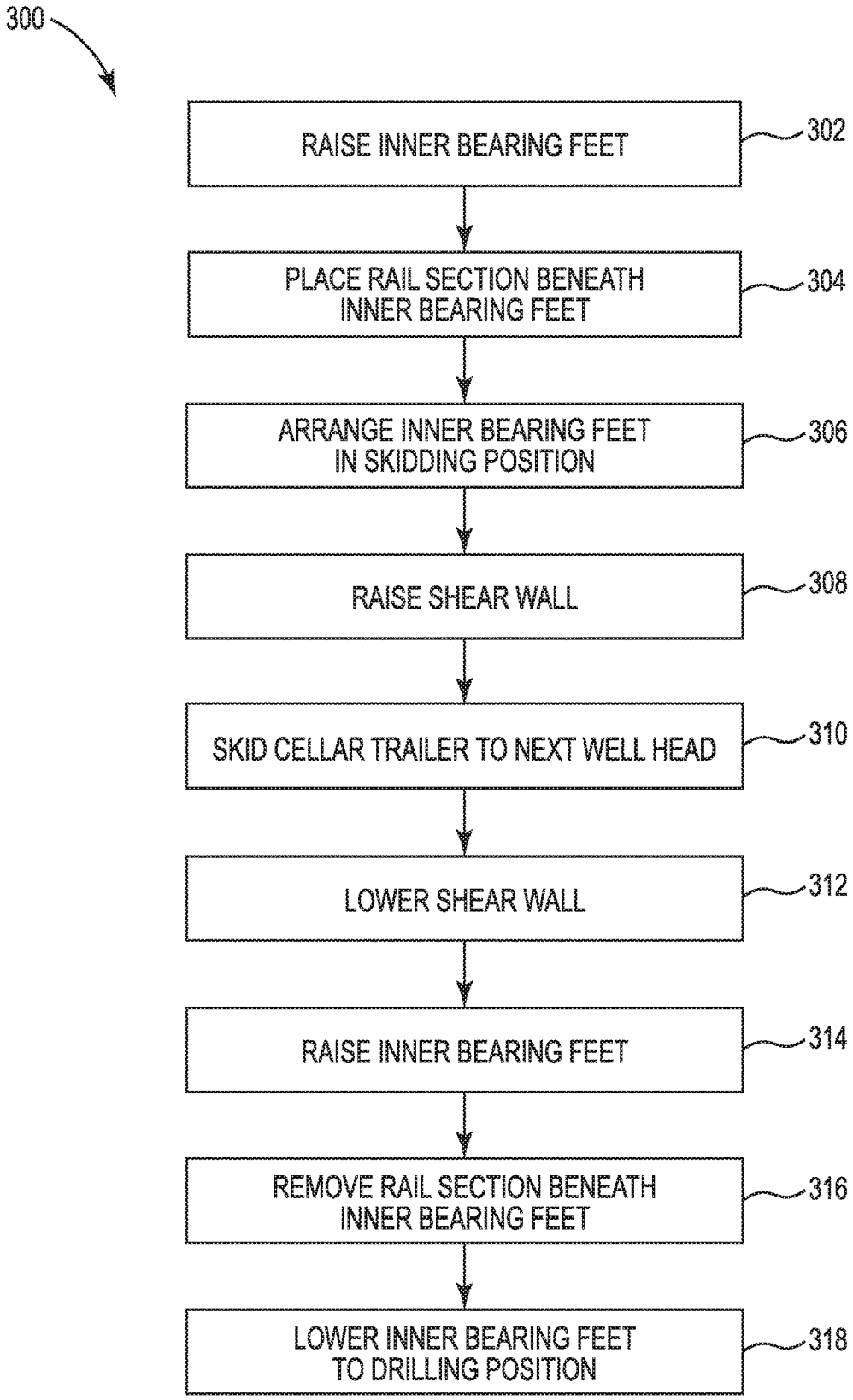
FIG. 30 is a method of skidding a cellar trailer of the present disclosure, according to one or more embodiments.

FIG. 30 provides a method 300 of skidding a cellar trailer 100 from a first well to a second well in a row of wells. The method may include raising the inner bearing feet 120 (302); placing a rail section 144 beneath the inner bearing feet (304); arranging the inner bearing feet in a skidding position on the rail (306); raising the shear wall 108 (308); skidding the trailer 100 to a next well head (310); lowering the shear wall (312); raising the inner bearing feet (314); removing a rail section from beneath the inner bearing feet (316); and lowering the inner bearing feet to a drilling position (318). It may be appreciated that before the trailer 100 is moved from a first well to a second well, the drilling rig may be decoupled from and removed from the well.

Raising the inner bearing feet 120 (302) may include hydraulically raising the inner bearing feet high enough such that a rail section 144 may be placed beneath them. While the inner bearing feet 120 are raised, the dead load of the trailer 100 may be supported by the shear wall 108 and the outer bearing feet 118. With the inner bearing feet 120 raised, a rail section 144 may be arranged behind the trailer 100 and beneath the inner bearing feet 120 (304). The rail section 144 may be arranged on one or more sawhorses 142, as shown in FIG. 28. The inner bearing feet 120 may be arranged in a skidding position on the rail section 144 (306). To reach the skidding position, the inner bearing feet 120 may be rotated in some embodiments in order to engage the rail section 144. For example, the inner bearing feet 120 may be rotated approximately 90 degrees in some embodiments. The rotated bearing feet 120 may be lowered onto the rail section 144 to engage the rail. In other embodiments, the inner bearing feet 120 may engage the rail without the need for rotation. Once the inner bearing feet 120 are in the skidding position, the shear wall 108 may be raised to a roading position. In some embodiments, outer rail sections 144 may be removed or rolled back to allow for a swing radius of the shear wall 108. However, in other embodiments, the shear wall 108 may be positioned such that it may extend beyond where the rail is positioned such that the rail need not be moved to accommodate raising or lowering of the shear wall.

With the shear wall 108 raised, the dead load of the trailer 100 may be supported by the inner 120 and outer 118 bearing feet. The trailer 100 may be skidded to a second well head (310) using, for example, walking feet or other movement mechanism(s). As the walking feet operate to move the trailer 100, the inner bearing feet 120 may be configured to slide or walk along the rail. Once the second well head is reached, the trailer 100 may be positioned once again for drilling operations. The shear wall 108 may be lowered to a drilling position (312). In some embodiments, outer rail sections 144 may be removed or rolled away so as to accommodate a swing radius of the shear wall 108. The inner bearing feet 120 may be raised (314), and the rail section 144 immediately behind the trailer 100 and under the inner bearing feet 120 may be removed (316). The inner bearing feet 120 may be rotated and/or lowered back to a drilling position (318).

Figure 31:
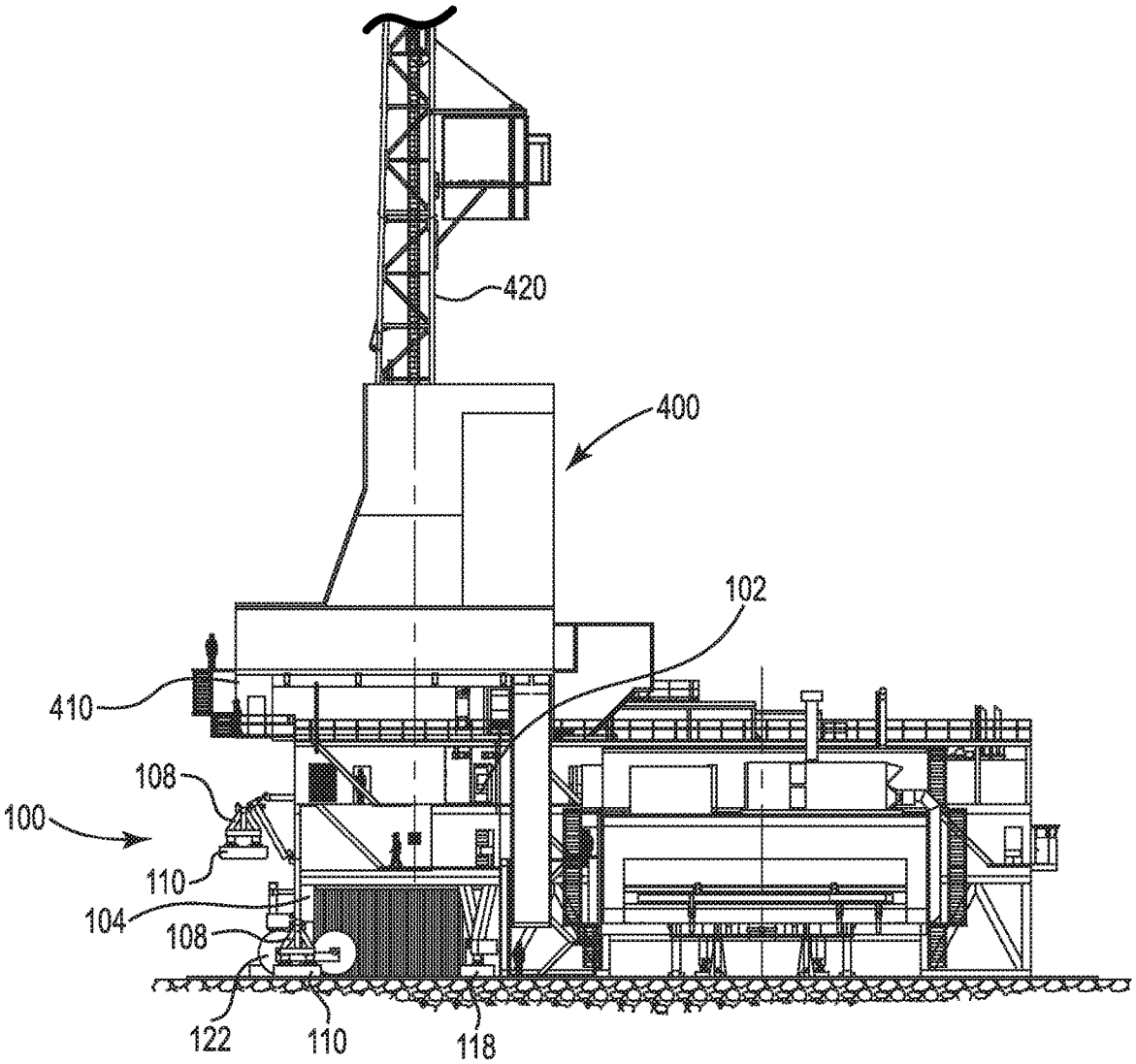
FIG. 31 is a side view of a drilling rig and cellar trailer of the present disclosure, according to one or more embodiments.
Figure 32:
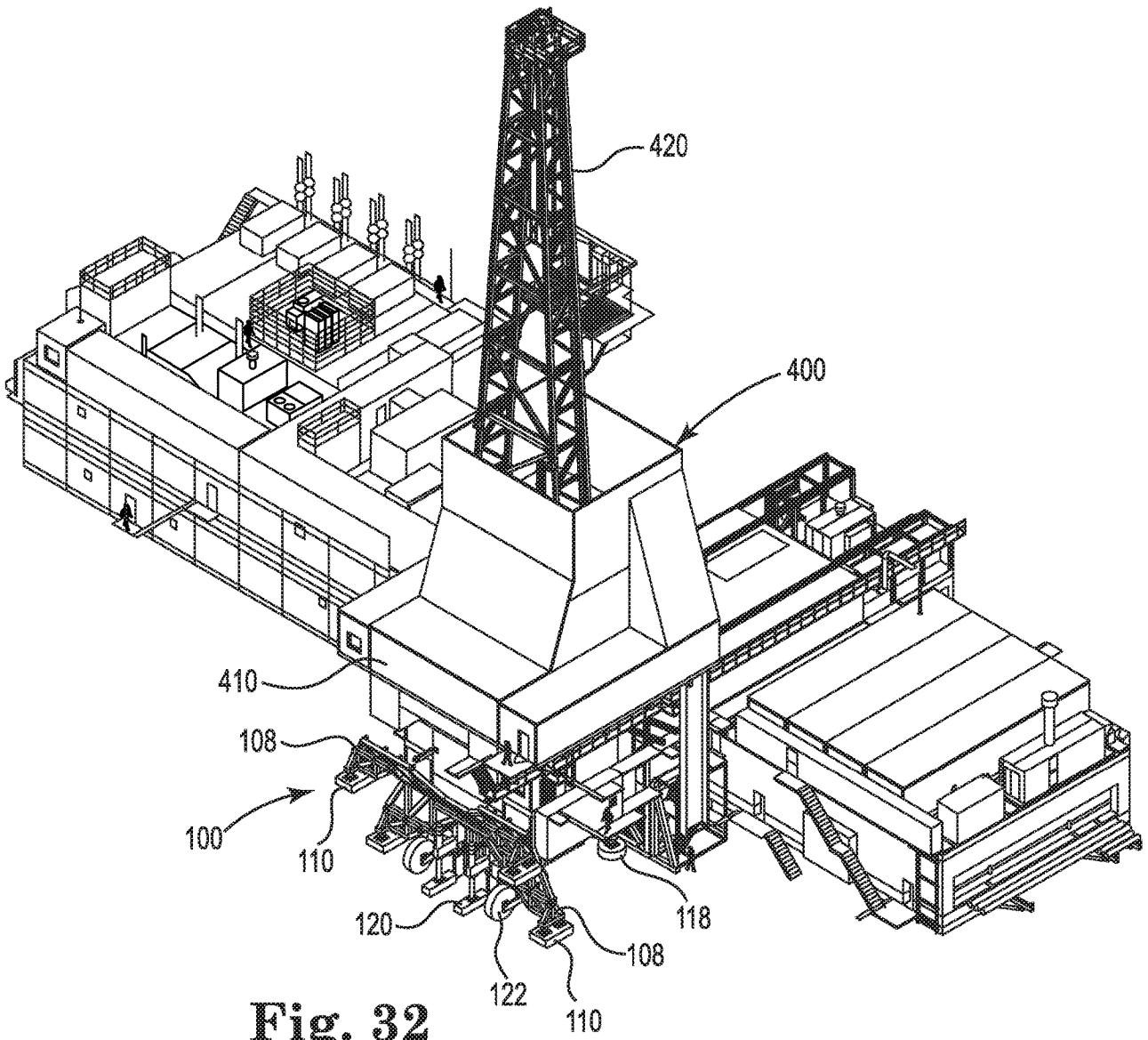
FIG. 32 is a perspective view of a drilling rig and cellar trailer of the present disclosure, according to one or more embodiments.
Figure 33:
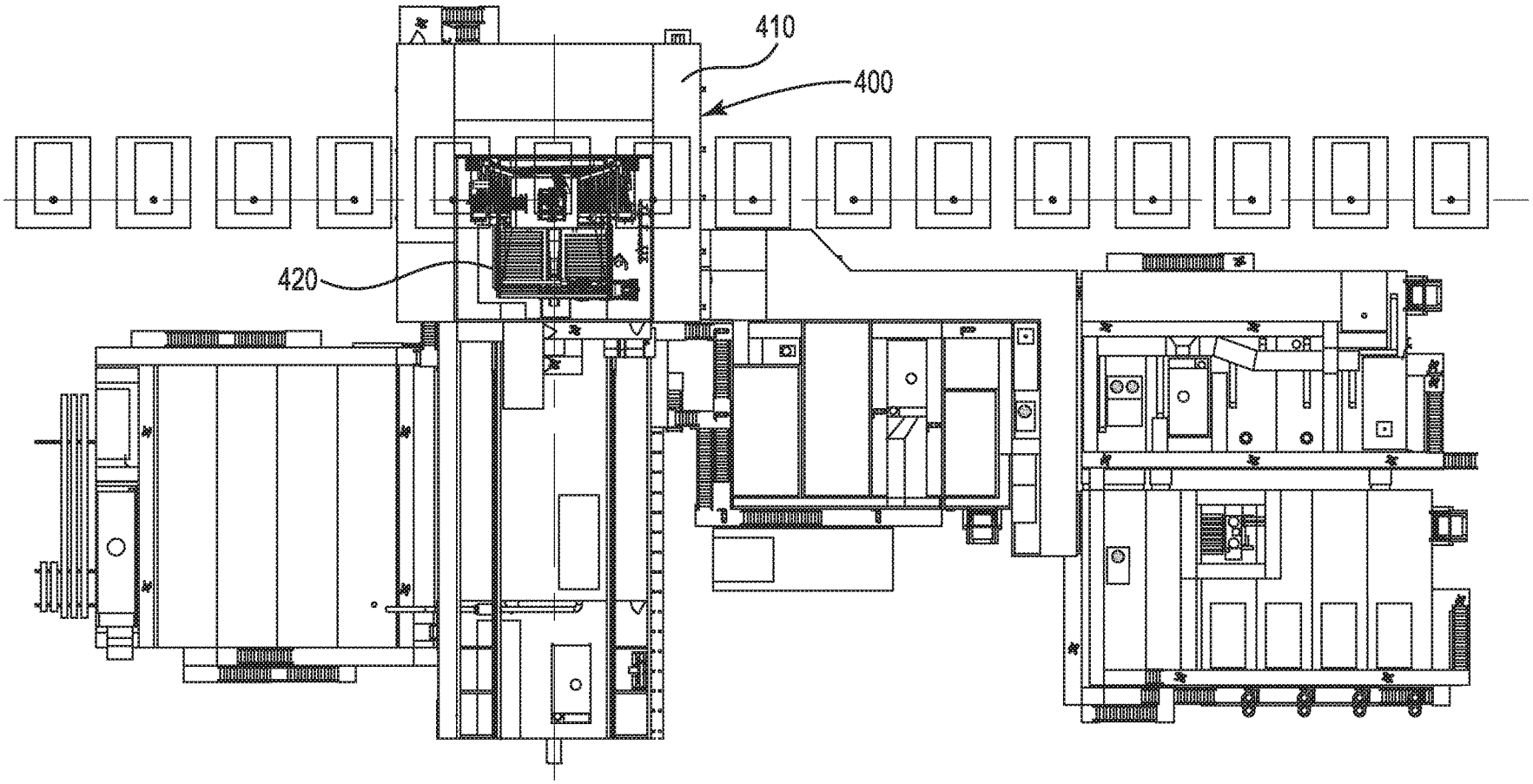
FIG. 33 is an overhead view of a drilling rig and cellar trailer of the present disclosure, according to one or more embodiments.
Figure 34:
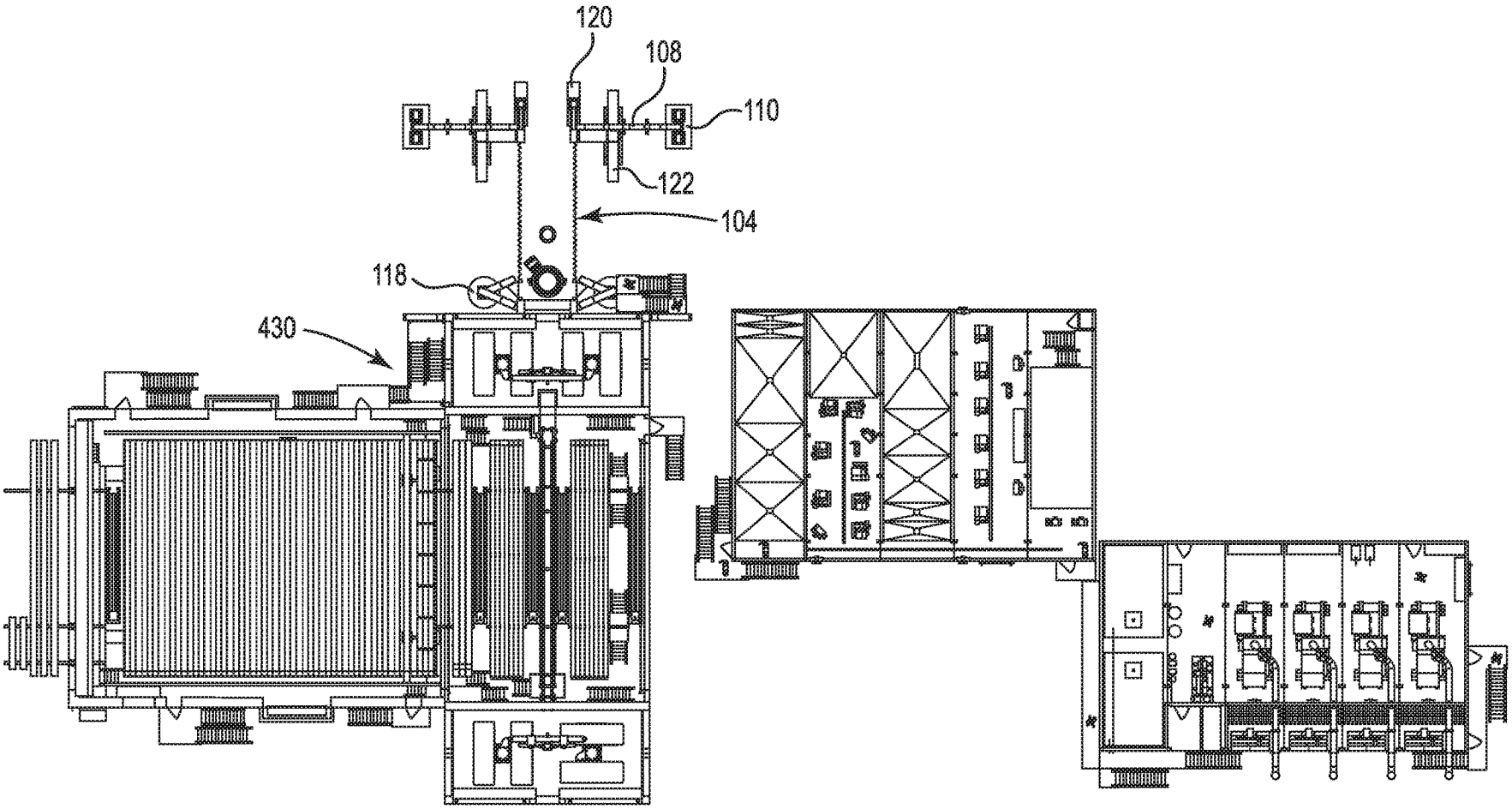
FIG. 34 is an overhead view of a drilling rig frame portion and a cellar trailer frame of the present disclosure, according to one or more embodiments.

FIGS. 31-33 show a cellar trailer 100 of the present disclosure in place over a well with a drilling rig 400. As shown, the drilling rig 400 may have a cantilevered drill floor 410 extending out over the trailer 100 and supporting a drilling mast 420. The trailer housing 102 and/or frame 104 may be coupled to the drilling rig 400 by hydraulic pins and/or other attachment means. In FIGS. 31 and 32, the shear wall 108 is shown in both a roading position and a drilling position. As described above, in the drilling position, the shear wall 108 may provide stiffening support to the drill floor 410. It may be appreciated that the trailer 100 may operate as part of the drilling rig structure when coupled to the drilling rig 400 and/or during drilling operations. FIG. 34 shows the frame 104 of the trailer 100 in place over a well with respect to a frame portion 430 of the drilling rig 400.

It may be appreciated that a cellar trailer of the present disclosure may generally accelerate drilling operations. In some embodiments, use of a cellar trailer may accelerate rig up and rig down time, at least because a cellar trailer may begin prepping operations before a drilling rig arrives or is ready to drill, and may continue closing drilling operations after or during rig down time of the drilling rig. In some embodiments, multiple cellar trailers may be used to further increase drilling efficiency. For example, on a multi-well pad drilling site, two cellar trailers may be used, such that one cellar trailer may be preparing a next well or closing down a previous well while another cellar trailer is engaged in drilling operations with a drilling rig. This may allow the drilling rig to move efficiently from well to well without waiting for preparation or closing operations before and after drilling.

As described above, a cellar trailer of the present disclosure may significantly reduce loading on a drilling rig by providing a separate modular structure for blowout preventer(s) and/or other well head or other equipment. This may be particularly beneficial in Arctic drilling, where ice roads require strict bearing limitations. Additionally, a cellar trailer of the present disclosure may provide support for a drill floor, such as a cantilevered drill floor, and thus may operate as part of the drilling rig structure during drilling operations. This may reduce or eliminate the need for stiffening legs conventionally used with cantilevered drill floors, which may further reduce the weight on the drill rig itself. It may be appreciated that a cellar trailer of the present disclosure may be useable with other types of drilling rigs beyond cantilevered rigs. Additionally, the benefits provided by a cellar trailer of the present disclosure may be realized with respect to drilling operations in regions other than Arctic or icy regions.

Various embodiments of the present disclosure may be described herein with reference to flowchart illustrations and/or block diagrams of methods or apparatus (systems). Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A drill rig cellar module for arrangement on a well head in conjunction with an otherwise self-supporting drill rig, the cellar module comprising:

a housing for storing well head equipment; and a frame coupled to and supporting the housing;

wherein, the frame and the housing are sized, shaped, and configured for removable placement over a well head, below a drill floor of the self-supporting drill rig, and amidst a substructure of the self-supporting drill rig.

2. The cellar module of claim 1, wherein the housing comprises a plurality of substructure enclosures.

3. The cellar module of claim 2, wherein the well head equipment comprises at least one blowout preventer.

4. The cellar module of claim 2, wherein the frame comprises a pair of bearing feet.

5. The cellar module of claim 4, wherein the bearing feet are inner bearing feet, and wherein the frame further comprises a pair of outer bearing feet.

6. The cellar module of claim 5, wherein the inner bearing feet are configured to engage a rail.

7. The cellar module of claim 2, wherein the frame comprises at least two tires.

8. The cellar module of claim 2, further comprising a shear wall configured to extend between a ground surface and the drill floor and configured to provide supplemental stiffening support to the drill floor of the drill rig, wherein the shear wall comprises a pair of bearing pads.

* * * * *